US009534446B2

(12) United States Patent
Williams

(10) Patent No.: US 9,534,446 B2
(45) **Date of Patent: *Jan. 3, 2017**

(54) FORMATION DIP GEO-STEERING METHOD

(71) Applicant: Danny T. Williams, Katy, TX (US)

(72) Inventor: Danny T. Williams, Katy, TX (US)

( * ) Notice: Subject to any disclaimer, the term of this patent is extended or adjusted under 35 U.S.C. 154(b) by 185 days.

This patent is subject to a terminal disclaimer.

(21) Appl. No.: 14/468,172

(22) Filed: Aug. 25, 2014

(65) Prior Publication Data

US 2014/0360781 A1 Dec. 11, 2014

Related U.S. Application Data

(63) Continuation of application No. 13/660,298, filed on Oct. 25, 2012, now Pat. No. 8,875,806, which is a continuation-in-part of application No. 13/568,269, filed on Aug. 7, 2012, now abandoned, which is a continuation of application No. 13/347,677, filed on Jan. 10, 2012, now abandoned, which is a continuation of application No. 13/154,508, filed on Jun. 7, 2011, now abandoned, which is a continuation of application No. 12/908,966, filed on Oct. 21, 2010, now abandoned, which is a continuation of application No. 12/431,339, filed on Apr. 28, 2009, now abandoned, which is a continuation of application No. 11/705,990, (Continued)

(51) Int. Cl.

| | |
|---|---|
| ***E21B 7/04*** | (2006.01) |
| ***E21B 7/06*** | (2006.01) |
| ***E21B 47/12*** | (2012.01) |
| *E21B 49/00* | (2006.01) |

(52) U.S. Cl.
CPC . *E21B 7/06* (2013.01); *E21B 7/04* (2013.01); *E21B 47/12* (2013.01); *E21B 49/00* (2013.01)

(58) Field of Classification Search
CPC ..... E21B 7/04; E21B 7/06; E21B 47/12
See application file for complete search history.

(56) References Cited

U.S. PATENT DOCUMENTS

| | | | |
|---|---|---|---|
| 514,170 | A | 2/1894 | Tesla |
| 2,176,169 | A | 10/1939 | Georges |

(Continued)

FOREIGN PATENT DOCUMENTS

| | | | |
|---|---|---|---|
| EP | 0015137 | A1 | 9/1980 |
| WO | 2011146079 | A1 | 11/2011 |

*Primary Examiner* — William P Neuder
(74) *Attorney, Agent, or Firm* — Buskop Law Group, PC; Wendy Buskop

(57) ABSTRACT

A method of drilling a subterranean well from a surface location. The method comprises estimating a target formation depth, estimating a target formation dip angle and calculating a target line that creates a top and bottom of the target formation that forms a first projection window. The method further includes drilling within the first projection window, transmitting information from the subterranean well and projecting a target deviation window. The method can further comprise ceasing the drilling of the well and performing a well survey so that well survey information is generated. The method can then include estimating a formation dip angle with the well survey information and rig surface equipment monitoring data, calculating a target line that creates a revised top and bottom of the target formation that forms a second projection window, and drilling within the second projection window.

8 Claims, 16 Drawing Sheets

Related U.S. Application Data filed on Feb. 14, 2007, now Pat. No. 7,546,209, which is a continuation of application No. 10/975,966, filed on Oct. 28, 2004, now Pat. No. 7,191,850.

(56) References Cited

U.S. PATENT DOCUMENTS

| | | | |
|---|---|---|---|
| 2,586,939 | A | 2/1952 | Grable |
| 2,658,284 | A | 11/1953 | Jacobs |
| 3,437,169 | A | 4/1969 | Youmans |
| 3,823,787 | A | 7/1974 | Haworth et al. |
| 4,386,664 | A | 6/1983 | Miller |
| 5,311,951 | A | 5/1994 | Kyte et al. |
| 5,678,643 | A | 10/1997 | Robbins et al. |
| 5,812,068 | A | 9/1998 | Wisler et al. |
| 5,821,414 | A | 10/1998 | Noy et al. |
| 6,272,434 | B1 | 8/2001 | Wisler et al. |
| 6,556,016 | B2 | 4/2003 | Gao et al. |
| 6,631,563 | B2 | 10/2003 | Brosnahan et al. |
| 6,643,589 | B2 | 11/2003 | Zhang et al. |
| 6,819,111 | B2 | 11/2004 | Fanini et al. |
| 6,877,241 | B2 | 4/2005 | Barr et al. |
| 6,885,947 | B2 | 4/2005 | Xiao et al. |
| 7,188,685 | B2 | 3/2007 | Downton et al. |
| 7,191,850 | B2 | 3/2007 | Williams |
| 7,546,209 | B2 | 6/2009 | Williams |
| 8,042,616 | B2 | 10/2011 | Giroux et al. |
| 8,061,442 | B2 | 11/2011 | Alberty |
| 8,875,806 | B2 * | 11/2014 | Williams ..... E21B 7/04 175/24 |
| 2003/0037963 | A1 | 2/2003 | Barr et al. |
| 2003/0056381 | A1 | 3/2003 | Brosnahan et al. |
| 2003/0121702 | A1 | 7/2003 | Downton et al. |
| 2003/0127252 | A1 | 7/2003 | Downton et al. |
| 2006/0090934 | A1 | 5/2006 | Williams |
| 2007/0205020 | A1 | 9/2007 | Williams |
| 2009/0260881 | A1 | 10/2009 | Williams |
| 2011/0031019 | A1 | 2/2011 | Williams |
| 2011/0232967 | A1 | 9/2011 | Williams |

* cited by examiner

Dip Calculation:

Inverse Tangent ({top of target in 16– top of target in 8} / distance between wells) = Dip in deg.

Example: Inverse Tangent ({2200' – 2280'} / 5000') = –0.9167 deg.

*Negative sign indicates down dip and positive sign indicates up dip.

| I | | II | | | III |
|---|---|---|---|---|---|
| OFFSET WELL | | TVD | MD | GR | VERTICAL DRIFT |
| 1010' | 106 | 1010.0 | 1010.0 | 100 | 100' |
| 1012' | 110 | 1015.0 | 1316.0 | 10 | 300' |
| 1012' | 112 | 1020.0 | 1822.0 | 10 | 800' |

| I | | II | | | III |
|---|---|---|---|---|---|
| OFFSET WELL | | TVD | TD | GR | VERTICAL DRIFT |
| 1009' | 114 | 1021.0 | 2225.0 | 40 | 1200' |
| 1010' | 116 | 1023.0 | 2327.0 | 10 | 1300' |
| 1015' | 118 | 1025.0 | 2530.0 | 90 | 1500' |

| I | | II | | | III |
|---|---|---|---|---|---|
| OFFSET WELL | | TVD | TD | GR | VERTICAL DRIFT |
| 1013.5' | 120 | 1024 | 2635.0 | 65 | 1575' |
| 1013.0' | 122 | 1026.5 | 3136.0 | 35 | 2035' |
| 1012.5' | 124 | 1027 | 3337.0 | 20 | 2175' |

| Svy | Depth | Inc | Azm | TVD | VS | DL | TPOS | TL | DIP | FAULT |
|---|---|---|---|---|---|---|---|---|---|---|
| 103 | 9562.00 | 90.40 | 117.20 | 5836.11 | 4009.98 | 1.53 | -8.34 | 5827.77 | -1.20 | 0.00 |
| BPrj | 9608.00 | 90.40 | 117.20 | 5835.79 | 4055.92 | 0.00 | -7.60 | 5828.19 | -0.53 | 0.00 |
| PA1 | 10052.29 | 90.45 | 120.00 | 5832.30 | 4500.00 | 0.63 | 0.00 | 5832.30 | -0.53 | 0.00 |
| PA2 | 10552.34 | 89.47 | 120.00 | 5836.92 | 5000.00 | 0.39 | 0.00 | 5836.92 | -0.53 | 0.00 |
| PA3 | 11052.38 | 89.47 | 120.00 | 5841.55 | 5500.00 | 0.00 | 0.00 | 5841.55 | -0.53 | 0.00 |
| PA4 | 11552.38 | 89.47 | 120.00 | 5846.18 | 6000.00 | 0.00 | 0.00 | 5846.18 | -0.53 | 0.00 |
| PA5 | 12052.41 | 89.47 | 120.00 | 5850.80 | 6500.00 | 0.00 | 0.00 | 5850.80 | -0.53 | 0.00 |

| 102 | 9467 | 91.80 | 117.60 | 5837.93 | 3915.10 | 1.20 | -12.15 | 5825.78 | -1.20 | |
|---|---|---|---|---|---|---|---|---|---|---|
| Svy | Depth | Inc | Azm | TVD | VS | DL | TPOS | TL | DIP | FAULT |
| 103 | 9562.00 | 90.40 | 117.20 | 5836.11 | 4009.98 | 1.53 | -8.34 | 5827.77 | -1.20 | 0.00 |
| BPrj | 9608.00 | 90.40 | 117.20 | 5835.79 | 4055.92 | 0.00 | -7.60 | 5828.19 | -0.53 | 0.00 |
| PA1 | 10052.29 | 90.45 | 120.00 | 5832.30 | 4500.00 | 0.63 | 0.00 | 5832.30 | -0.53 | 0.00 |
| PA2 | 10552.34 | 89.47 | 120.00 | 5836.92 | 5000.00 | 0.39 | 0.00 | 5836.92 | -0.53 | 0.00 |
| PA3 | 11052.36 | 89.47 | 120.00 | 5841.55 | 5500.00 | 0.00 | 0.00 | 5841.55 | -0.53 | 0.00 |
| PA4 | 11552.38 | 89.47 | 120.00 | 5846.18 | 6000.00 | 0.00 | 0.00 | 5846.18 | -0.53 | 0.00 |
| PA5 | 12052.41 | 89.47 | 120.00 | 5850.80 | 6500.00 | 0.00 | 0.00 | 5850.80 | -0.53 | 0.00 |

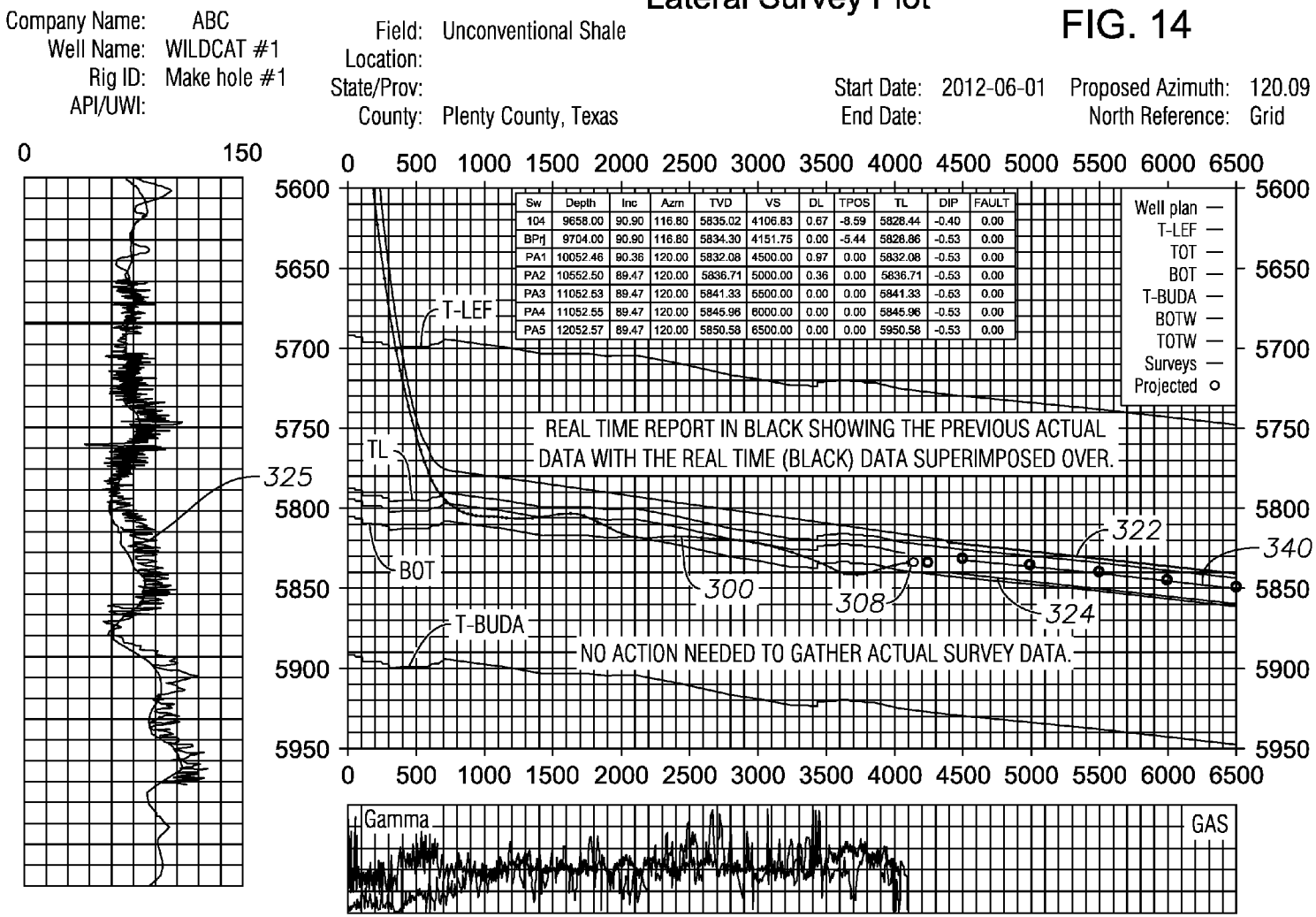
Lateral Survey Plot
FIG. 14
Company Name: ABC
Well Name: WILDCAT #1
Rig ID: Make hole #1
API/UWI:
Field: Unconventional Shale
Location:
State/Prov:
County: Plenty County, Texas
Start Date: 2012-06-01
End Date:
Proposed Azimuth: 120.09
North Reference: Grid
Sw Depth Inc Azm TVD VS DL TPOS TL DIP FAULT
104 9658.00 90.90 116.80 5835.02 4106.83 0.67 -8.59 5828.44 -0.40 0.00
BPrj 9704.00 90.90 116.80 5834.30 4151.75 0.00 -5.44 5828.86 -0.53 0.00
PA1 10052.46 90.36 120.00 5832.08 4500.00 0.97 0.00 5832.08 -0.53 0.00
PA2 10552.50 89.47 120.00 5836.71 5000.00 0.36 0.00 5836.71 -0.53 0.00
PA3 11052.53 89.47 120.00 5841.33 5500.00 0.00 0.00 5841.33 -0.63 0.00
PA4 11052.55 89.47 120.00 5845.96 6000.00 0.00 0.00 5845.96 -0.53 0.00
PA5 12052.57 89.47 120.00 5850.58 6500.00 0.00 0.00 5950.58 -0.53 0.00
Well plan
T-LEF
TOT
BOT
T-BUDA
BOTW
TOTW
Surveys
Projected
REAL TIME REPORT IN BLACK SHOWING THE PREVIOUS ACTUAL
DATA WITH THE REAL TIME (BLACK) DATA SUPERIMPOSED OVER.
NO ACTION NEEDED TO GATHER ACTUAL SURVEY DATA.
T-LEF
TL
BOT
T-BUDA
325
300
308
322
324
340
Gamma
GAS

| Sw | Depth | Inc | Azm | TVD | VS | DL | TPOS | TL | DIP | FAULT |
|---|---|---|---|---|---|---|---|---|---|---|
| 104 | 9658.00 | 90.90 | 116.80 | 5835.02 | 4106.83 | 0.67 | -8.59 | 5828.44 | -0.40 | 0.00 |
| BPrj | 9704.00 | 90.90 | 116.80 | 5834.30 | 4151.75 | 0.00 | -5.44 | 5828.86 | -0.53 | 0.00 |
| PA1 | 10052.46 | 90.36 | 120.00 | 5832.08 | 4500.00 | 0.97 | 0.00 | 5832.08 | -0.53 | 0.00 |
| PA2 | 10552.50 | 89.47 | 120.00 | 5836.71 | 5000.00 | 0.36 | 0.00 | 5836.71 | -0.53 | 0.00 |
| PA3 | 11052.53 | 89.47 | 120.00 | 5841.33 | 5500.00 | 0.00 | 0.00 | 5841.33 | -0.53 | 0.00 |
| PA4 | 11052.55 | 89.47 | 120.00 | 5845.96 | 6000.00 | 0.00 | 0.00 | 5845.96 | -0.53 | 0.00 |
| PA5 | 12052.57 | 89.47 | 120.00 | 5850.58 | 6500.00 | 0.00 | 0.00 | 5950.58 | -0.53 | 0.00 |

FIG. 15

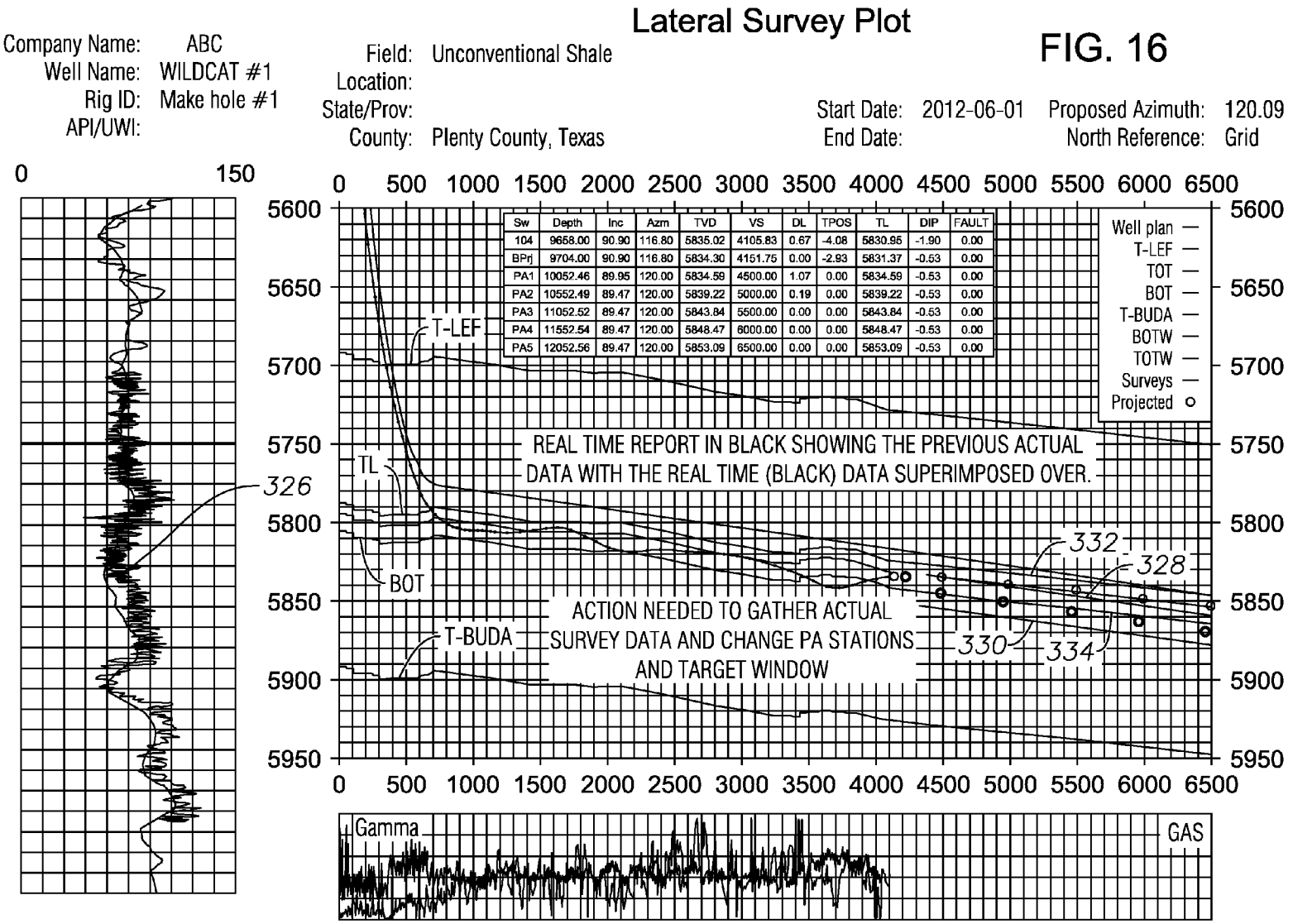
Lateral Survey Plot
FIG. 16
Company Name: ABC
Well Name: WILDCAT #1
Rig ID: Make hole #1
API/UWI:
Field: Unconventional Shale
Location:
State/Prov:
County: Plenty County, Texas
Start Date: 2012-06-01
End Date:
Proposed Azimuth: 120.09
North Reference: Grid
Sw Depth Inc Azm TVD VS DL TPOS TL DIP FAULT
104 9658.00 90.90 116.80 5835.02 4105.83 0.67 -4.08 5830.95 -1.90 0.00
BPj 9704.00 90.90 116.80 5834.30 4151.75 0.00 -2.93 5831.37 -0.53 0.00
PA1 10052.46 89.95 120.00 5834.59 4500.00 1.07 0.00 5834.59 -0.53 0.00
PA2 10552.49 89.47 120.00 5839.22 5000.00 0.19 0.00 5839.22 -0.53 0.00
PA3 11052.52 89.47 120.00 5843.84 5500.00 0.00 0.00 5843.84 -0.53 0.00
PA4 11552.54 89.47 120.00 5848.47 6000.00 0.00 0.00 5848.47 -0.53 0.00
PA5 12052.56 89.47 120.00 5853.09 6500.00 0.00 0.00 5853.09 -0.53 0.00
Well plan
T-LEF
TOT
BOT
T-BUDA
BOTW
TOTW
Surveys
Projected
REAL TIME REPORT IN BLACK SHOWING THE PREVIOUS ACTUAL
DATA WITH THE REAL TIME (BLACK) DATA SUPERIMPOSED OVER.
ACTION NEEDED TO GATHER ACTUAL
SURVEY DATA AND CHANGE PA STATIONS
AND TARGET WINDOW
T-LEF
TL
BOT
T-BUDA
326
328
330
332
334
Gamma
GAS

| Sw | Depth | Inc | Azm | TVD | VS | DL | TPOS | TL | DIP | FAULT |
|---|---|---|---|---|---|---|---|---|---|---|
| 104 | 9658.00 | 90.90 | 116.80 | 5835.02 | 4105.83 | 0.67 | -4.08 | 5830.95 | -1.90 | 0.00 |
| BPrj | 9704.00 | 90.90 | 116.80 | 5834.30 | 4151.75 | 0.00 | -2.93 | 5831.37 | -0.53 | 0.00 |
| PA1 | 10052.46 | 89.95 | 120.00 | 5834.59 | 4500.00 | 1.07 | 0.00 | 5834.59 | -0.53 | 0.00 |
| PA2 | 10552.49 | 89.47 | 120.00 | 5839.22 | 5000.00 | 0.19 | 0.00 | 5839.22 | -0.53 | 0.00 |
| PA3 | 11052.52 | 89.47 | 120.00 | 5843.84 | 5500.00 | 0.00 | 0.00 | 5843.84 | -0.53 | 0.00 |
| PA4 | 11552.54 | 89.47 | 120.00 | 5848.47 | 6000.00 | 0.00 | 0.00 | 5848.47 | -0.53 | 0.00 |
| PA5 | 12052.56 | 89.47 | 120.00 | 5853.09 | 6500.00 | 0.00 | 0.00 | 5853.09 | -0.53 | 0.00 |

FIG. 17

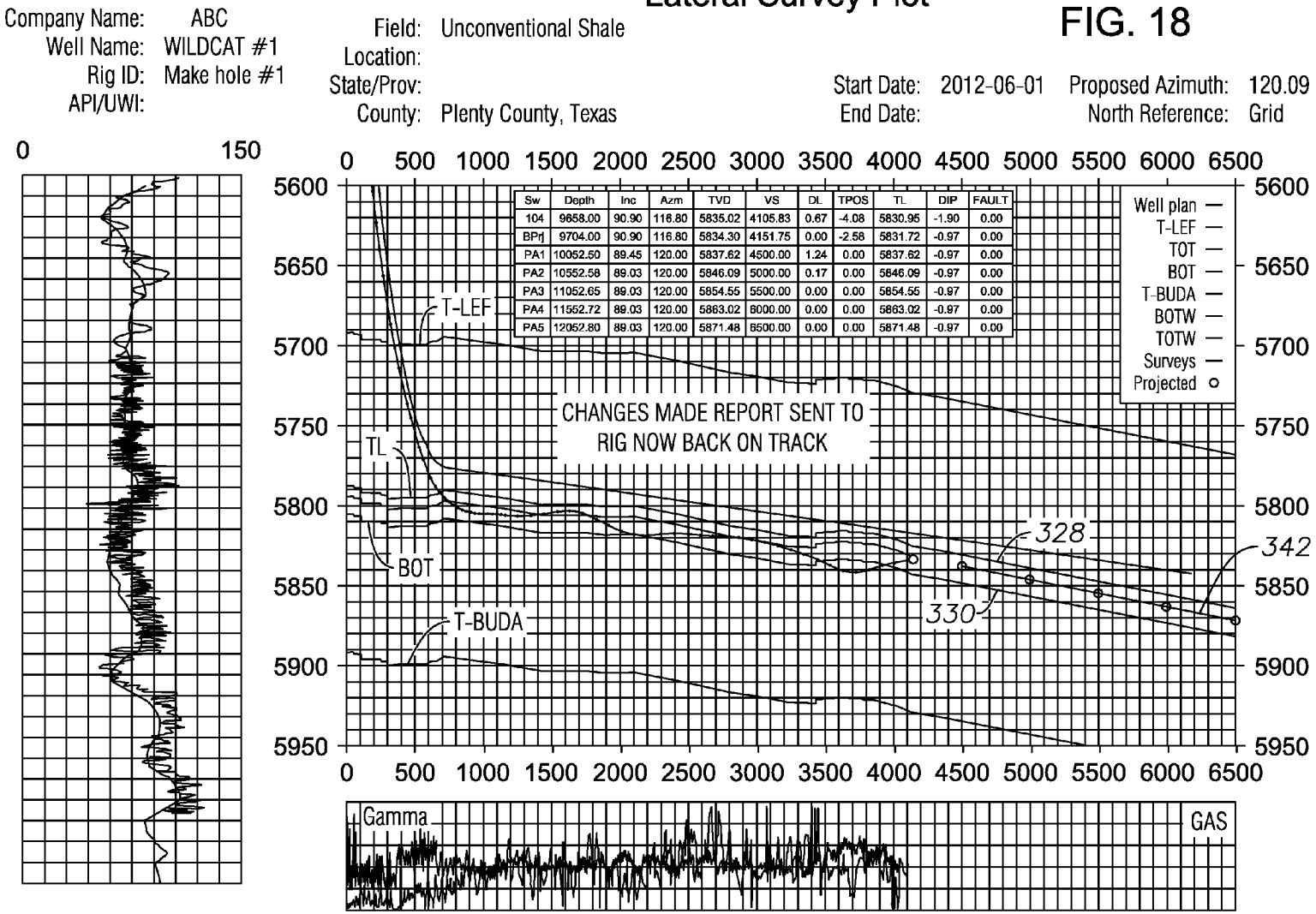
Lateral Survey Plot
FIG. 18
Company Name: ABC
Well Name: WILDCAT #1
Rig ID: Make hole #1
API/UWI:
Field: Unconventional Shale
Location:
State/Prov:
County: Plenty County, Texas
Start Date: 2012-06-01
End Date:
Proposed Azimuth: 120.09
North Reference: Grid
Sw Depth Inc Azm TVD VS DL TPOS TL DIP FAULT
104 9658.00 90.90 116.80 5835.02 4105.83 0.67 -4.08 5830.95 -1.90 0.00
BPrj 9704.00 90.90 116.80 5834.30 4151.75 0.00 -2.58 5831.72 -0.97 0.00
PA1 10052.50 89.45 120.00 5837.62 4500.00 1.24 0.00 5837.62 -0.97 0.00
PA2 10552.58 89.03 120.00 5846.09 5000.00 0.17 0.00 5846.09 -0.97 0.00
PA3 11052.65 89.03 120.00 5854.55 5500.00 0.00 0.00 5854.55 -0.97 0.00
PA4 11552.72 89.03 120.00 5863.02 6000.00 0.00 0.00 5863.02 -0.97 0.00
PA5 12052.80 89.03 120.00 5871.48 6500.00 0.00 0.00 5871.48 -0.97 0.00
CHANGES MADE REPORT SENT TO
RIG NOW BACK ON TRACK
T-LEF
TL
BOT
T-BUDA
328
330
342
Well plan
T-LEF
TOT
BOT
T-BUDA
BOTW
TOTW
Surveys
Projected
Gamma
GAS
0
150
5600
5650
5700
5750
5800
5850
5900
5950
0
500
1000
1500
2000
2500
3000
3500
4000
4500
5000
5500
6000
6500

FORMATION DIP GEO-STEERING METHOD

CROSS REFERENCE TO RELATED APPLICATIONS

This application is a continuation of co-pending U.S. patent application Ser. No. 13/660,298 filed on Oct. 25, 2012, which is a continuation-in-part of application Ser. No. 13/568,269 filed on Aug. 7, 2012, now abandoned, which is continuation of application Ser. No. 13/347,677 filed Jan. 10, 2012, now abandoned, which is a continuation of application Ser. No. 13/154,508 filed on Jun. 7, 2011, now abandoned, which is a continuation of application Ser. No. 12/908,966 filed Oct. 21, 2010, now abandoned, which is a continuation of application Ser. No. 12/431,339 filed Apr. 28, 2009, now abandoned, which is a continuation of application Ser. No. 11/705,990 filed Feb. 14, 2007, issued as U.S. Pat. No. 7,546,209 on Jun. 9, 2009, which is a continuation of application Ser. No. 10/975,966 filed on Oct. 28, 2004, issued as U.S. Pat. No. 7,191,850 on Mar. 20, 2007.

FIELD

The present embodiments relate to methods of steering a drill bit, and more specifically, but not by way of limitation, to a method of geo-steering a bit while drilling directional and horizontal wells.

BACKGROUND

In the exploration, drilling, and production of hydrocarbons, it becomes necessary to drill directional and horizontal wells. As those of ordinary skill in the art appreciate, directional and horizontal wells can increase the production rates of reservoirs. Hence, the industry has seen a significant increase in the number of directional and horizontal wells drilled. Additionally, as the search for hydrocarbons continues, operators have increasingly been targeting thin beds and/or seams with high to very low permeability. The industry has also been targeting unconventional hydrocarbon reservoirs such as tight sands, shales, and coal.

Traditionally, these thin bed reservoirs, coal seams, shales and sands may range from less than five feet to twenty feet. In the drilling of these thin zones, operators attempt to steer the drill bit within these zones. As those of ordinary skill in the art will recognize, keeping the well bore within the zone is highly desirable for several reasons including, but not limited to, maintaining greater drilling rates, maximizing production rates once completed, limiting water production, preventing well bore stability problems, exposing more productive zones, etc.

Various prior art techniques have been introduced. However, all these techniques suffer from several problems. For instance, in the oil and gas industry, it has always been an accepted technique to gather surface and subsurface information and then map or plot the information to give a better understanding of what is actually happening below the earth's surface. Some of the most common mapping techniques used today include elevation contour maps, formation contour maps, subsea contour maps and formation thickness (isopac) maps. Some or most of these can be presented together on one map or separate maps. For the most part, the information that is gathered to produce these maps are from electric logging and real time measurement while drilling and logging devices (gamma ray, resistivity, density neutron, sonic or acoustic, surface and subsurface seismic or any available electric log). This type of data is generally gathered after a well is drilled. Additionally, measurement while drilling and logging while drilling techniques allow the driller real time access to subterranean data such as gamma ray, resistivity, density neutron, and sonic or acoustic and subsurface seismic. This type of data is generally gathered during the drilling of a well.

These logging techniques have been available and used by the industry for many years. However, there is a need for a technique that will utilize historical well data and real time downhole data to steer the bit through the zone of interest. There is a need for a method that will produce, in real time during drilling, an instantaneous dip for a very thin target zone. There is also a need for a process that will utilize the instantaneous dip to produce a calculated target window (top and bottom) and extrapolate this window ahead of the projected well path so an operator can keep the drill bit within the target zone identified by the calculated dip and associated calculated target window.

In the normal course of drilling, it is necessary to perform a survey. As those of ordinary skill in the art will appreciate, in order to guide a wellbore to a desired target, the position and direction of the wellbore at any particular depth must be known. Since the early days of drilling, various tools have been developed to measure the inclination and azimuth of the wellbore.

In order to calculate the three dimensional path of the wellbore, it is necessary to take measurements along the wellbore at known depths of the inclination (angle from vertical) and azimuth (direction normally relative to true north). These measurements are called surveys.

Prior art survey tools include those run on wireline such as but not limited to steering tools as well as those associated with measurement while drilling (MWD), electro-magnetic measurement while drilling (EM-MWD) and magnetic single shot (MSS). Hence, after drilling a hole section, a wireline survey is run inside the drill pipe before pulling out with the drill bit, or by running a wireline survey inside the steel casing once it is cemented in place. During drilling, many government regulations require the running of a wireline survey or getting an MWD survey, or EM-MWD survey, such as in some cases every 200 feet for horizontal wells and every 500 feet for deviated wells.

In today's environment of drilling and steering in ultra-thin target zones, knowing the true stratigraphic position and direction of the bit within the true stratigraphic formation is critical. Operators need to know the accurate position of the bit and bit projection path. In the event of an actual deviation from a planned strata-graphic wellbore projection path, time is critical in order to correct the bit direction back to the planned true stratigraphic path to prevent the bit from drilling into nonproductive zones.

BRIEF DESCRIPTION OF THE DRAWINGS

The detailed description will be better understood in conjunction with the accompanying drawings as follows:

FIG. 14 is a sequential view of the wellbore plot seen in FIG. 12.

FIG. 15 is a chart providing real time data used in the generation of the target line that creates top and bottom targets seen in FIG. 14.

FIG. 16 is a sequential view of the wellbore plot seen in FIG. 14.

FIG. 17 is a chart providing real time data used in the generation of the target line that creates top and bottom targets seen in FIG. 16.

FIG. 18 is a sequential view of the wellbore plot seen in FIG. 17.

Figure 1:
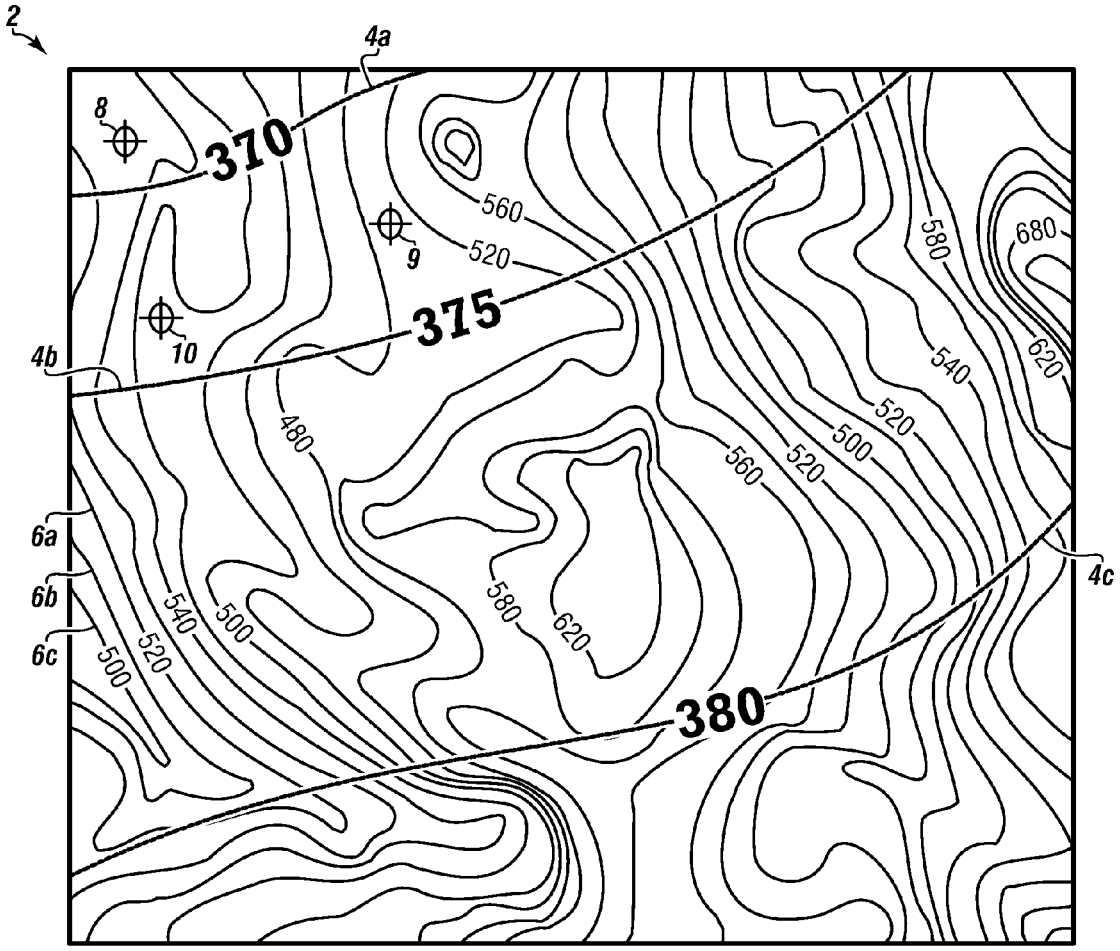
FIG. 1 is a surface elevation and formation of interest contour map with offset well locations.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

A method of drilling a well is disclosed. The method includes selecting a target subterranean reservoir and estimating the formation depth of the target reservoir. The method further includes calculating an estimated formation dip angle of the target reservoir based on data selected from the group consisting of: offset well data, seismic data, core data, and pressure data. Then, the top of the target reservoir is calculated and then the bottom of the target reservoir is calculated so that a target window is established.

The method further includes projecting the target window ahead of the intended path and drilling the well. Next, the target reservoir is intersected. The target formation is logged with a measurement while drilling means and data representative of the characteristics of the reservoir is obtained with the measurement while drilling means selected from the group consisting of, but not limited to: gamma ray, density neutron, sonic or acoustic, subsurface seismic and resistivity. The method further includes, at the target reservoir's intersection, revising the top of the target reservoir and revising the bottom of the target reservoir to properly represent their position in relationship to the true stratigraphic position (TSP) of the drill bit, through dip manipulation to match the real time log data to correlate with the offset data, and thereafter, projecting a revised target window.

The method further comprises correcting the top of the target reservoir and the bottom of the target reservoir through dip manipulation to match the real time logging data to the correlation offset data to directionally steer the true stratigraphic position of the drill bit and stay within the new calculated target window while drilling ahead. In one preferred embodiment, the step of correcting the top and bottom of the target reservoir includes adjusting an instantaneous formation dip angle (ifdip) based on the real time logging and drilling data's correlation to the offset data in relationship to the TSP of the drill bit so that the target window is adjusted (for instance up or down, wider or narrower), to reflect the target window's real position as it relates to the TSP of the drill bit. The method may further comprise drilling and completing the well for production.

In one embodiment, the estimated formation dip angle is obtained by utilizing offset well data that includes offset well data such as electric line logs, seismic data, core data, and pressure data. In one of the most preferred embodiments, the representative logging data obtained includes a gamma ray log.

In one preferred embodiment, a method of drilling a well with a bit within a target subterranean reservoir is disclosed. The method comprises modeling and calculating an estimated formation dip angle, drilling the well with a logging while drilling measurement tool (LWD) and obtaining real time data representative of the characteristics of the reservoir. The method further includes collecting information from any rig surface monitoring equipment data and the LWD tool at the well surface location, transmitting this information to a remote control unit, modeling and calculating a target line that creates a top and bottom of the formation utilizing an instantaneous formation dip angle (ifdip), and wherein the ifdip is calculated based on the real time representative data correlated to an offset well data generated from an offset well. The method includes plotting and evaluating the rig surface equipment monitoring data with the LWD interpreted data. Next, a target window is projected for drilling the well. The method further comprises projecting a target window deviation, generating a target window deviation flag, transmitting the target window deviation flag to the well surface location, and ceasing the drilling of the well to perform a well survey. The method further comprises, after a deviation flag evaluation process, sending detailed drilling instructions pertaining to drilling distance required and orientation of the down hole drilling equipment during a well path correction resulting from the deviation flag evaluation process.

The method may further include drilling the well with the LWD tool and obtaining real time data representative of the characteristics of the reservoir, collecting real time information from the LWD tool at the well surface, and transmitting the real time information to the remote control unit. Next, the method comprises modeling and calculating a revised target line that creates a top and bottom of the formation utilizing the ifdip and plotting and evaluating the rig surface equipment monitoring data with the LWD ifdip interpreted data, then projecting a second target window for drilling the well. As per the teachings of this disclosure, the method may also include projecting a second real time target window deviation from the revised target line, transmitting a second target window deviation flag to the well surface location and ceasing the drilling to perform a second well survey.

In another embodiment, a method of drilling a subterranean well from a surface location is disclosed. The method comprises estimating a target formation depth and a target formation dip angle, calculating a target line that creates a top and bottom of the target formation that forms a first projection window, and drilling within the first projection window. The method also includes transmitting information from the subterranean well, projecting a target deviation, ceasing the drilling of the well, and performing a well survey so that well survey information is generated. The method may also include estimating a formation dip angle with the well survey information, calculating a revised target line that creates a revised top and bottom of the target formation that forms a second projection window, drilling within the second projection window, and transmitting information from the subterranean well. As per the teachings of this disclosure, the method may also comprise projecting a second target deviation using a revised target line, ceasing the drilling of the well, and performing a second well survey so that well survey information is generated.

An advantage of the present invention includes use of logs from offset wells such as gamma ray, resistivity, density neutron, sonic or acoustic, and surface and subsurface seismic. Another advantage is that the present invention will use data from these logs and other surface and down hole data to calculate a dip for a very thin target zone. Yet another advantage is that during actual drilling, the method herein disclosed will produce a target window (top and bottom) and extrapolate this window ahead of the projected well path so an operator can keep the drill bit within the target zone identified by the ifdip and target window.

A feature of the present invention is that the method uses real time drilling and logging data and historical data to recalculate the instantaneous dip of the target window as to its correlation of the real time logging data versus the offset wells data in relationship to the TSP of the drill bit within the target window. Another feature is that the method will then produce a new target window (top and bottom) and wherein this new window is extrapolated outward. Yet another feature is that this new window will be revised based on actual data acquired during drilling such as, but not limited to, the real time gamma ray indicating bed boundaries. Yet another feature is that the projection window is controlled by the top of the formation of interest as well as the bottom of the formation of interest. In other words, a new window will be extrapolated based on real time information adjusting the top and/or bottom of the formation of interest as it relates to the TSP of the drill bit within that window, through the correlation of the real time logging and drilling data to the offset well data.

Turning now to the Figures, FIG. 1 is a surface elevation with formation of interest contour map 2 with offset well locations will now be described. As seen in FIG. 1, the subsurface top of target formation of interest (FOI) contour lines (see generally 4*a*, 4*b*, 4*c*) are shown. Also shown in FIG. 1 are the surface elevation lines (see generally 6*a*, 6*b*, 6*c*). FIG. 1 also depicts the offset well locations 8, 9 and 10, and as seen on the map, these offset well locations contain the target formation window thickness as intersected by those offset wells.

As understood by those of ordinary skill in the art, map 2 is generated using a plurality of tools such as logs, production data, pressure buildup data, and core data from offset wells 8, 9 and 10. Geologist may also use data from more distant wells. Additionally, seismic data can be used in order to help in generating map 2.

Figure 2:
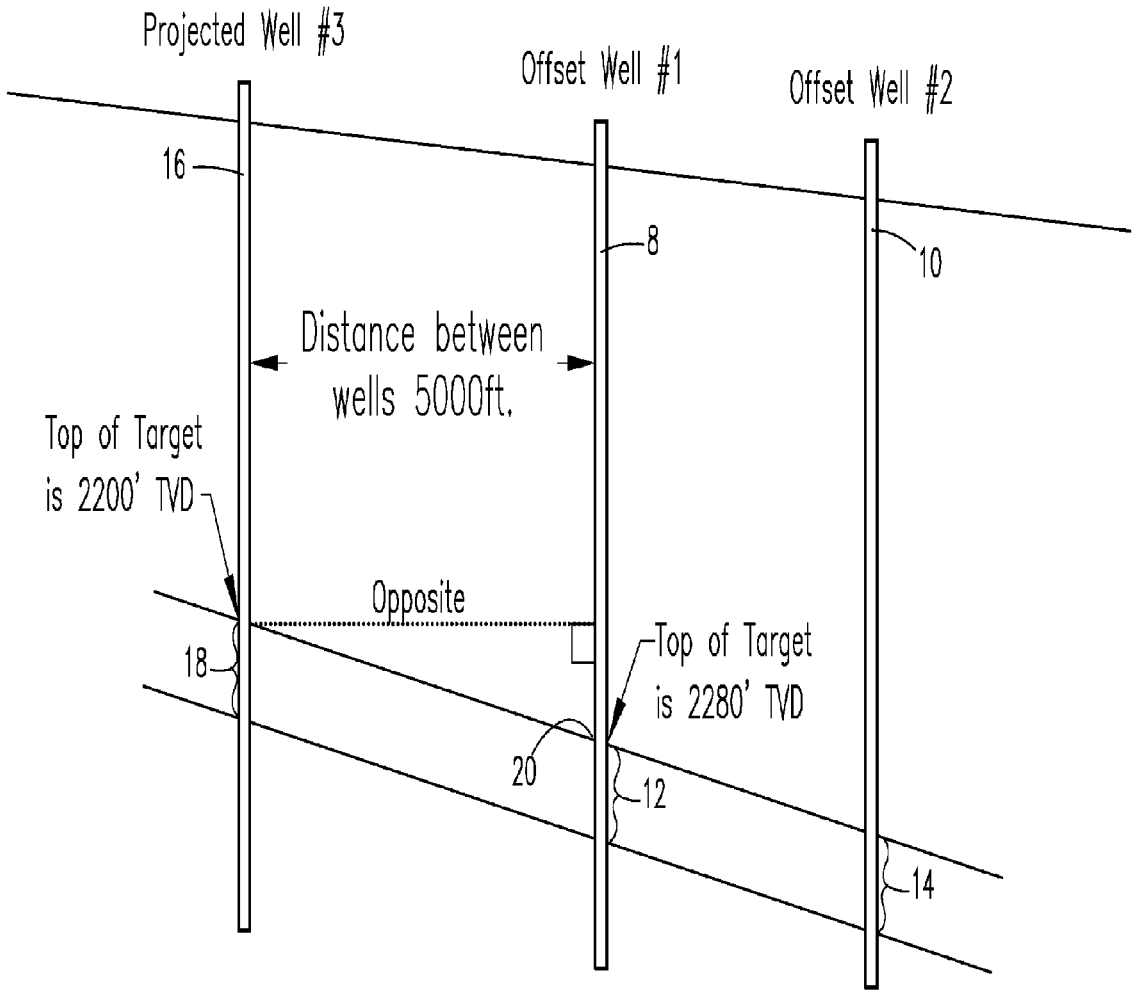
FIG. 2 is a partial cross-sectional geological view of two offset wells and a proposed well along with a dip calculation example.

Referring now to FIG. 2, a partial cross-sectional geological view of two offset wells and a proposed well 16 is shown. More specifically, FIG. 2 depicts the offset well 8 and the offset well 10. The target formation of interest, which will be a subterranean reservoir in one embodiment, is identified in well 8 as 12, and in well 10 as 14. The formation of interest is shown in an up dip orientation from offset wells 10 to 8 in relationship to the position of the proposed well 16.

The proposed well 16 is shown up dip relative to wells 8 and 10, and the formation of interest that would intersect the proposed well bore is denoted as numeral 18. An operator may wish to drill the well bore slightly above the formation of interest, or until the top of the target formation of interest, or through the formation of interest, and thereafter kick-off at or above the target formation of interest drilling a highly deviated horizontal well bore to stay within the target formation of interest. FIG. 2 depicts wherein the formation dip angle can be readily ascertained. For instance, the angle at 20 is known by utilizing the geometric relationship well known in the art. For example, the operator may use the tangent relationship, wherein the tangent is equal to the opposite side divided by the adjacent side and the ratio is then converted to degrees; hence, the formation dip angle is easily calculated. It should be noted that other factors can be taken into account when calculating the formation dip angle as noted earlier. Data from seismic surveys can be used to modify the formation dip angle as readily understood by those of ordinary skill in the art.

In the most preferred embodiment, the dip is calculated as follows: ([top of target in proposed well 16−top of target in offset well 8]/distance between wells).times.inverse tangent=dip in degrees.

Therefore, assuming that the top of the target in well 16 is 2200' TVD, the top of the target in well 8 is 2280', and the distance between the wells is 5000', the following calculation provides the dip angle: ([2200'−2280']/5000').times.inverse tangent=−0.9167 degrees {note: the negative sign indicates down dip and positive sign indicates up dip}

Figure 3:
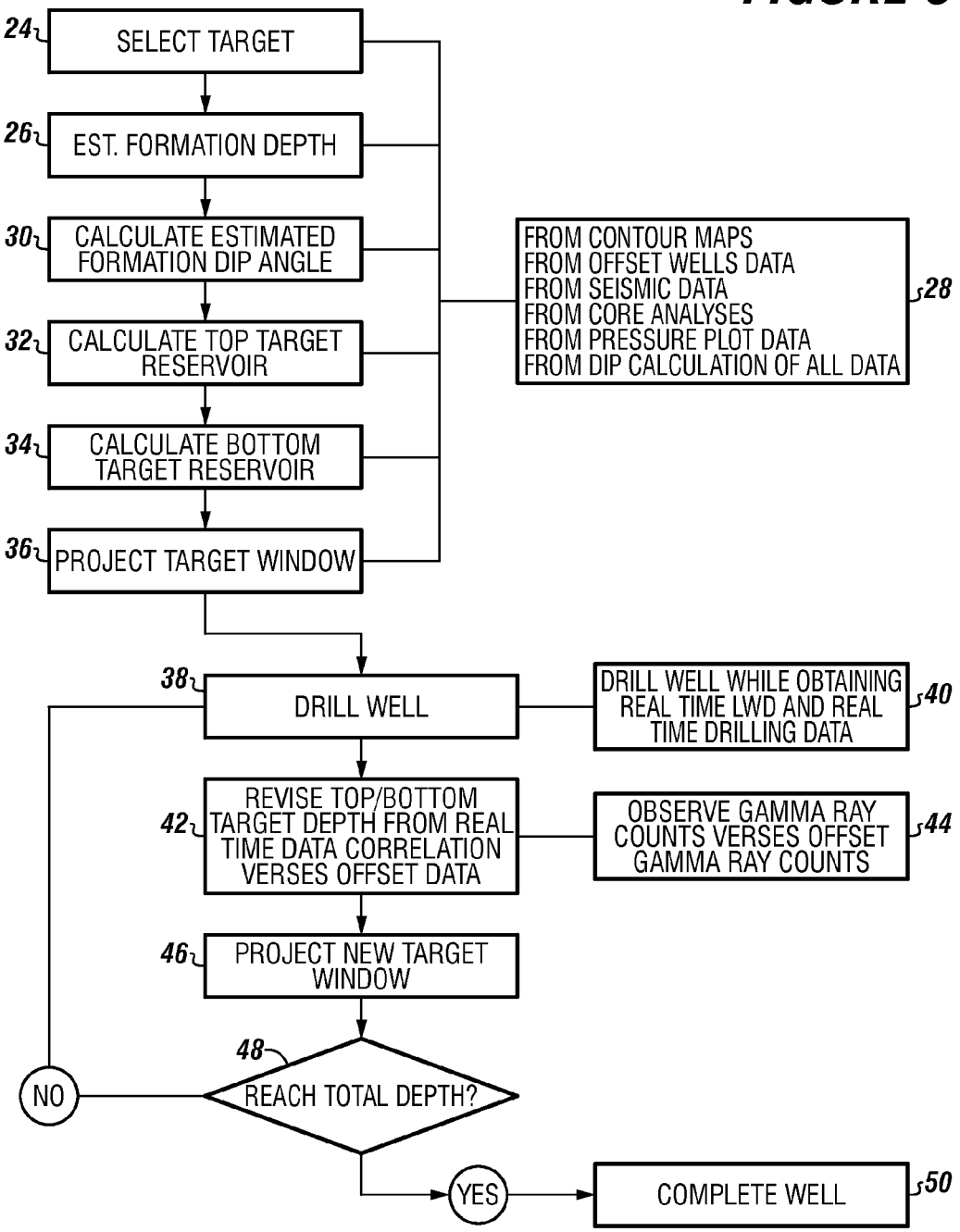
FIG. 3 is a flow chart of the method of one embodiment of the present invention.

Referring now to FIG. 3, a flow chart of one of the most preferred embodiments of the method of the present invention is illustrated. Initially, a target formation of interest is selected 24. An estimation of the formation depth of the target formation is calculated 26 utilizing known techniques and uses input data from the map 2, offset well data, seismic data, and contour maps (step seen generally at 28), as noted earlier. The method further includes calculating the estimated formation dip angle 30. One of the preferred methods of determining the formation dip angle was described with reference to FIG. 2 (and as seen in the example dip calculation previously presented). Parameters used to calculate the formation dip angle were described with reference to step 28, which includes utilizing the map 2, offset well data, seismic data, etc.

Next, the method includes calculating a top of the formation of interest 32 and then a bottom of the formation of interest 34. The method comprises projecting this top and bottom target window 36 which includes as it starting frame the top of formation 32 and the bottom of formation 34. Once the target window is selected, the operator can begin drilling the well 38. As appreciated by those of ordinary skill in the art, the drill string will have measurement while drilling (MWD) and/or logging while drilling (LWD) tools 40 which will log the formation for real time subterranean information. The information may be resistivity, gamma ray, neutron density, etc. There will also be real time drilling data being recorded such as rate of penetration (ROP), torque and drag, formation returns at the surface, rotating speed, weight on bit (WOB), etc.

Based on the observed data from the LWD tools 40 and real time drilling data, the top and bottom of the formation will be revised 42 through instantaneous dip manipulation to match the real time logging and drilling data as it correlates to the offset data, to properly represent their position in relationship to the TSP of the drill bit. The calculated formation dip angle at any particular instance during the drilling process is referred to as the instantaneous formation dip angle (ifdip). The revisions will be based on the observed data and its relationship to the TSP of the drill bit through the correlation of the real time logging data versus the offset well data. The TSP is determined by using the real time logging data and drilling data and correlating it to the offset wells data to locate the TSP of the bit within the well's target window.

Based on where the TSP of the drill bit is, a dip will be created that will reposition the target window around the TSP of the drill bit. This dip will then be used to change the target window and project it ahead for further drilling. In the most preferred embodiment, the data will be the gamma ray API counts 44. Normally, the gamma ray counts indicative of a hydrocarbon reservoir, and in this embodiment are between 0 and 50 API units. With the revised top FOI and bottom FOI, a new target window can be projected 46. If the bit goes outside the projected window (i.e. either above the top of the formation of interest or below the formation of interest), the ifdip is incorrect and a new window, and in turn a new ifdip, is calculated as per the teachings of this invention.

If the total depth has been reached (as seen in step 48), then drilling can cease and the well can be completed using conventional completion techniques 50. If the total depth has not been reached, then the method includes returning to step 38 and wherein the loop repeats i.e. the drilling continues, LWD data is obtained, the top and bottom of the FOI is revised (42) and a new target window is generated and projected (46).

Figures 4A, 4B:
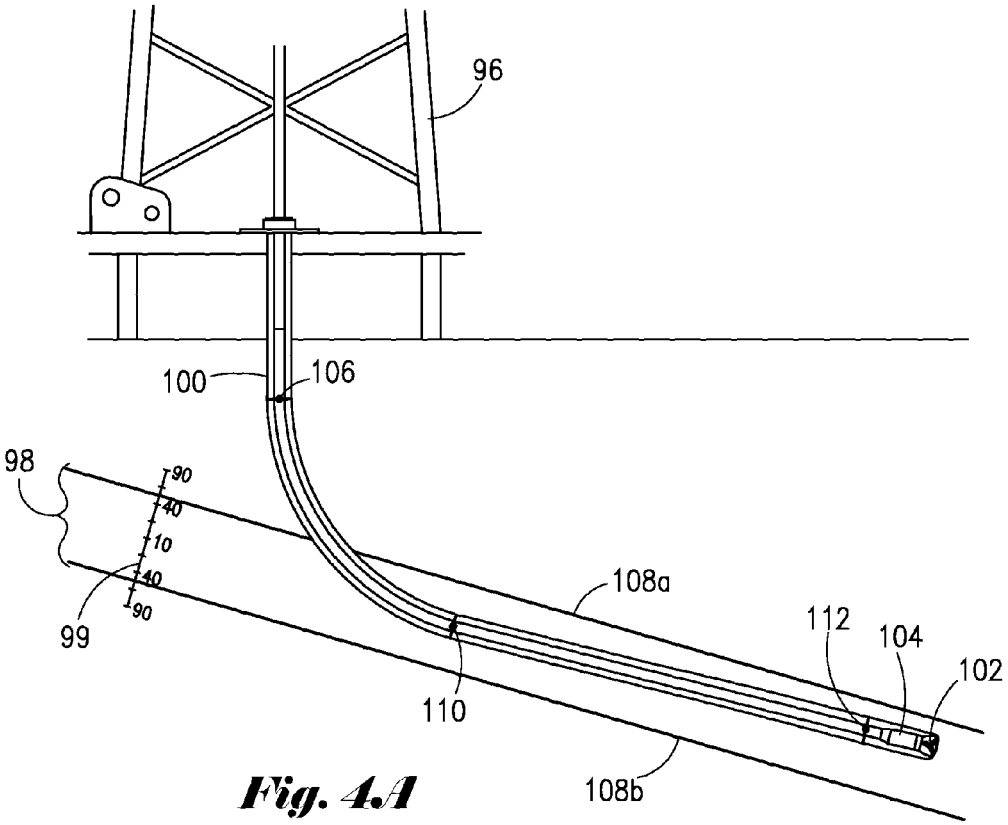
FIG. 4A is a schematic view of a deviated well being drilled from a rig.
FIG. 4B is a chart of gamma ray data obtained from the well seen in FIG. 4A.

Referring now to FIG. 4A, a schematic view of a deviated well being drilled from a rig 96 will now be described. As will be appreciated by those of ordinary skill in the art, a well is drilled into the subterranean zones. The target zone is indicated by the numeral 98, and wherein the target zone 98 has an estimated formation dip angle as set out in step 30 of FIG. 3 (the calculation was previously presented). Returning to FIG. 4A, the offset well log data for zone 98 is shown in numeral 99 for the target zone wherein 99 represents the distribution of gamma counts through the target zone 98 as based on the offset well data.

Figures 5A, 5B:
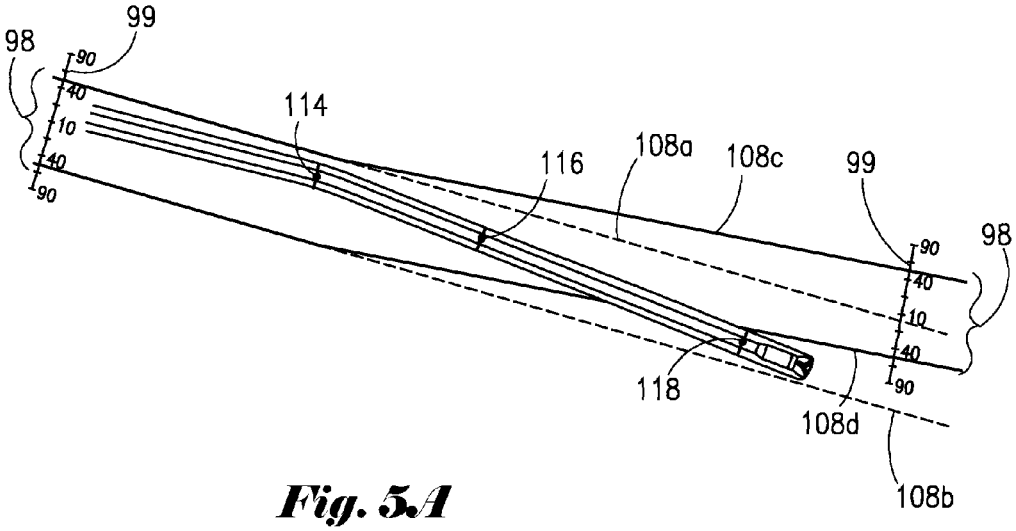
FIG. 5A is the schematic seen in FIG. 4A after further extended drilling.
FIG. 5B is a chart of gamma ray data obtained from the well seen in FIG. 5A.
Figures 6A, 6B:
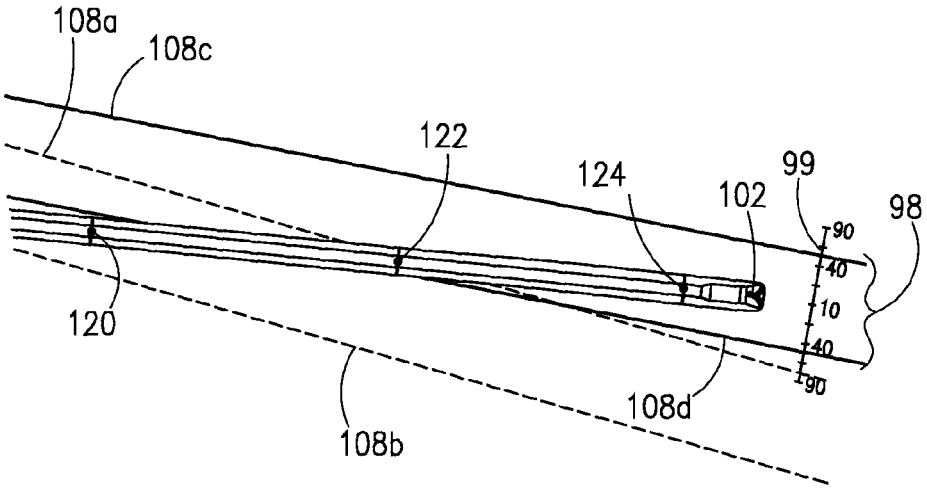
FIG. 6A is the schematic seen in FIG. 5A after further extended drilling.
FIG. 6B is a chart of gamma ray data obtained from the well seen in FIG. 6A.

The well being drilled is denoted by the numeral 100. The operator will drill the well with a drill bit 102 and associated logging means such as a logging while drilling means (seen generally at 104). During the drilling, the operator will continue to correlate the geologic formations being drilled to the offset well drilling and logging data (99) as it relates to the real time drilling and logging data. Once the operator believes that the well 100 is at a position to kick off into the target zone 98, the operator will utilize conventional and known directional techniques to effect the side track, as will be readily understood by those of ordinary skill in the art. A slant well technique, as understood by those of ordinary skill in the art, can also be employed to drill through the target zone, logging it, identify the target zone, plug back and sidetrack to intersect the zone horizontally. As seen at point 106, the operator, based on correlation to known data, kicks off the well 100 utilizing known horizontal drilling techniques. As seen in FIG. 4B, a chart records real time logging data, such as gamma ray counts from the well 100. The charts seen in FIGS. 4B, 5B, and 6B depict three (3) columns: column I shows the true vertical depth (TVD) of the offset well's associated gamma counts previously discussed with reference to numeral 99; column II is the actual well data from well 100; and, column III is the vertical drift distance of the actual well 100 from the surface location.

Hence, at point 106, the well is at a true vertical depth of 1010', a measured depth of 1010' and the gamma ray count is at 100 API units; the depth of the bit relative to the offset well's associated gamma count is 1010'. The estimated formation dip angle is calculated at point 106 by the methods described in FIG. 3, step 30 and in the discussion of FIG. 2. The correlation of the offset well data (99) to the real time logging data verifies that the estimated formation dip angle currently being used accurately positions the drill bit's TSP in relationship to the target window. Based on this correlation, the estimated formation dip angle can be used as the ifdip to generate the target window to drill ahead. As noted earlier, the ifdip is the instantaneous formation dip angle based on real time logging and drilling data correlation to offset well logging and drilling data as it relates to the TSP of the drill bit.

As noted earlier, the operator kicks off into the target zone 98. As per the teachings of the present invention, a top of formation of interest and a bottom of formation of interest has been calculated via the estimated formation dip angle, which in turn defines the window. Moreover, this window is projected outward as seen by projected bed boundaries 108*a*, 108*b*. The LWD means 104 continues sending out signals, receiving the signals, and transmitting the received processed data to the surface for further processing and storage as the well 100 is drilled. The top of the formation of interest is intersected and confirms that the estimated formation dip angle used is correct. The operator, based on the LWD information and the formation of interest top intersection can use the current estimated formation dip and project the window to continue drilling, which in effect becomes the instantaneous formation dip angle (ifdip). As noted at point 110, the well is now at a true vertical depth of 1015', a total depth of 1316' and the real time gamma ray count at 10 API units.

The correlation of the offset well data (99) and real time logging data verify that the drill bit's true stratigraphic position (TSP) is within the target window. The ifdip, according to the teachings of the present invention, can be changed if necessary to shift the top and bottom window so they reflect the drill bit's TSP within the window. Since the gamma count reading is 10, it correlates to the offset wells (99) 10 gamma count position. Therefore, the actual collected data confirms that the well 100, at point 110, is positioned within the target window when the drill bit's TSP at point 110 was achieved. The instantaneous formation dip angle (ifdip) is calculated at point 110 by the following: inv. tan. [(offset well TVD-real time well TVD)/distance between points]=−0.57 29 degrees, and is used to shift the window in relationship to the drill bit's TSP, and can now be used to project the window ahead so drilling can continue.

As seen in FIG. 4A, the operator continues to drill ahead. The operator actually drills a slightly more up-dip bore hole in the window as seen at point 112. As seen in FIG. 4B, the LWD indicates that the true vertical depth is 1020', the measured depth is 1822' and the gamma ray count is 10 API units, confirming the projected window is correct. The previous instantaneous formation dip angle (ifdip) can continue to be used since the real time logging data at point 112 correlates to the offset log data 99 as it relates to the drill bit's TSP within the target window, and is calculated at point 112 by the following: inv. tan. [(offset well TVD-real time well TVD)/distance between points]=−0.57 29 degrees.

Referring now to FIG. 5A, a schematic representation of the continuation of the extended drilling of well 100 seen in FIG. 4A will now be described. At point 114, the LWD indicates that the true vertical depth is 1021', the measured depth is 2225' and the real time gamma ray count is 40 API units. The vertical drift distance from the surface location is 1200'. Thus, the correlation between the real time gamma ray count and the offset gamma ray count (99) verifies the drill bit's TSP is within the target window and the projected window continues to be correct as seen by applying the already established calculation. At point 116, the drill bit has stayed within the projected window, and the chart in FIG. 5B indicates that the true vertical depth is 1023' while the measured depth is 2327' and the gamma ray count is 10; the vertical drift distance from the surface location is 1300'. Hence, as per the correlation procedure previously discussed, the projected window is still correct. The instantaneous formation dip angle is calculated at point 116 by the following: inv. tan. [(offset well TVD-real time well TVD)/distance between points]=−0.57 29 degrees. The same ifdip can be used to project the window ahead to continue drilling.

At point 118 of FIG. 5A, the driller has drilled ahead slightly more down dip. The projected window indicates that the bit should still be within the projected window. However, the chart seen in FIG. 5B indicates that the bit has now exited the projected window by the indication that the gamma ray counts are at 90 API units. Note that the true vertical depth is 1025' and the measured depth is 2530, and the vertical drift distance is 1500'. Therefore, as per the teachings of the present invention, the projected window requires modification. This is accomplished by changing the instantaneous formation dip angle (ifdip) so that the drill bit's TSP is located below the bottom of the target window just enough to lineup the real time logging gamma data to the offset well gamma data (99). This is accomplished by decreasing the target formation window's dip angle just enough to line up the correlation stated above. The instantaneous formation dip angle is calculated at point 118 by the following: inv. tan. [(offset well TVD-real time well TVD)/distance between points]=−0.3820 degreesdown dip. Based on this new formation dip angle, the top of the formation window is now indicated at 108*c* and the bottom of the formation window is now indicated at 108*d*. FIG. 5A indicates that the dip angle for the target reservoir does in fact change, and a new window with the new instantaneous formation dip angle is projected from this stratigraphic point on and drilling can proceed. Note the previous window boundaries of 108*a* and 108*b*.

Referring now to FIG. 6A, the new window has been projected i.e. window boundaries 108*c* and 108*d*. The instantaneous formation dip angle (ifdip), as per the teachings of this invention, indicate that the dip angle of the formation of interest has changed to reflect the drill bit's TSP from the correlation of real time logging and drill data to offset data and the target formation window adjusted to the new instantaneous formation dip angle. At point 120, the operator has begun to adjust the bit inclination so that the bit is heading back into the new projected window. As noted earlier, the bottom formation of interest 108*d* and the top formation of interest 108*c* have been revised. FIG. 6B confirms that the bit is now at a true vertical depth of 1024' and a total depth of 2635' at point 120, wherein the gamma ray count is at 65 units. The instantaneous formation dip angle is calculated at point 120 by the following: inv. tan. [(offset well TVD-real time well TVD)/distance between points]=−0.3820 degrees. The correlation procedure mentioned earlier of using the offset well gamma data 99 to compare with real time data indicates that the adjustment made to the bit inclination has indeed placed the drill bit's TSP right below the new target window's bottom. This is shown by the real time logging data gamma ray unit of 65 units (see FIG. 6B) lining up with the offset well's gamma ray unit of 65 units (99) below the new target formation window that was created with the previous instantaneous dip angle at point 118.

At point 122, the operator has maneuvered the bit back into the projected window. The real time data found in FIG. 6B confirms that the bit 102 has now reentered the target zone, as well as being within the projected window, wherein the TVD is 1026.5' and the measured depth is 3136' and the gamma ray count is now at 35 API units. The instantaneous formation dip angle (ifdip) used on the projected window is now verified by the correlation procedure mentioned earlier being based on the instantaneous dip formation angle of −0.3820 degrees. The point 124 depicts the bit within the zone of interest according to the teachings of the present invention. As seen in FIG. 6B, at point 124, the bit is at a true vertical depth of 1027' and a measured depth of 3337'. The gamma ray reads 20 API units therefore confirming that the bit is within the zone of interest. The instantaneous formation dip angle (ifdip) can now be used to project the target window ahead and drilling can continue. The instantaneous formation dip angle is calculated at point 124 by the following: inv. tan. [(offset well TVD-real time well TVD)/distance between points]=−0.3820 degrees. Any form of drilling for oil and gas, utility crossing, in mine drilling and subterranean drilling (conventional, directional or horizontally) can use this invention's method and technique to stay within a target zone window.

Figure 7:
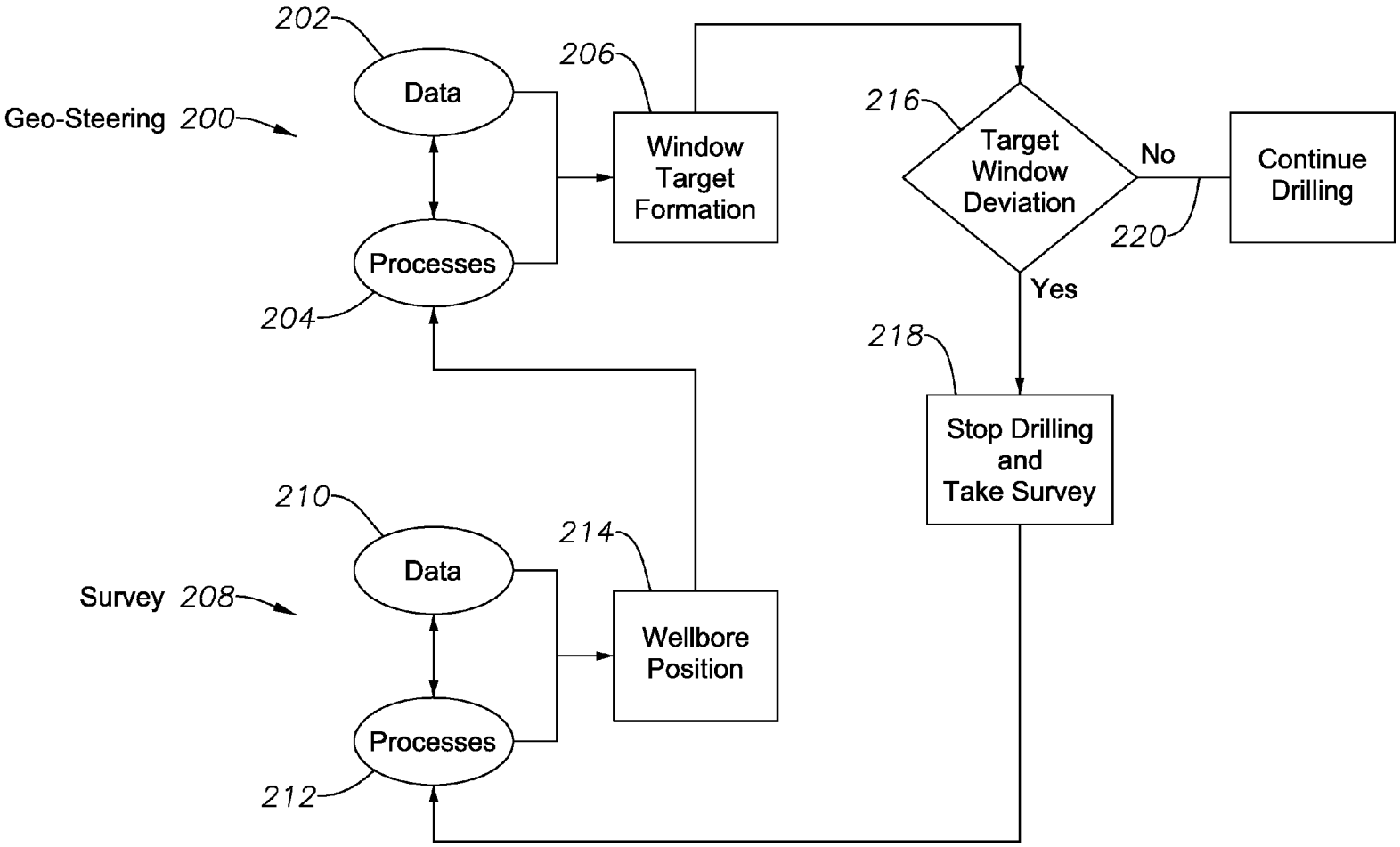
FIG. 7 is a systems diagram of one preferred embodiment of the process herein disclosed.

Referring now to FIG. 7, a systems diagram of a second embodiment of the process herein disclosed will be described. The geo-steering technique 200 of this disclosure includes data collection 202 from sources previously mentioned e.g. MWD, EM-MWD, LWD, rig surface equipment monitoring data drilling parameters, seismic, offset wells, etc. The rig surface equipment monitoring data includes, but is not limited to, weight on bit, revolutions per minute of the bit, pump rate through the work string and the bit, and wherein the rig surface equipment monitoring data is generated by well-known surface equipment typically found on drilling rigs. The data 202 is imported into the geo-steering process 204 in order to model and calculate a stratagraphic position of the wellbore and generate the target formation window 206, as fully disclosed herein. The systems diagram of FIG. 7 also includes the survey technique 208, wherein the survey technique 208 includes the survey data 210, which is gathered along with the geo steering data 202 which includes data from wireline survey instruments, EM-MWD survey instruments, LWD survey instruments, MWD survey instruments, rig surface monitoring equipment data, etc. As depicted in FIG. 7, the processes 212 of the survey technique includes well known processes in the art that are combined with data 210 to generate the wellbore's trigonometric position 214. The wellbore's trigonometric position 214 is provided to the geo-steering process 204, which in turn is used with modeling and calculating a stratagraphic position of the wellbore to modify the target formation window 206 if appropriate.

As per the teachings of this disclosure, in the course of drilling, the output of the target formation window 206 may indicate a deviation 216 from the planned stratagraphic well path, which in turn will generate a message (i.e. flag) by the system to stop drilling and perform a survey 218. In the event that no deviation from the planned stratagraphic well path is generated (220), then the system allows for continued drilling, monitoring, calculating and modeling. As seen in FIG. 7, if the message is sent regarding a deviation from the planned stratagraphic well path (218), the system directs the message to the survey processes 212 so that survey data 210 can be taken along with geosteering data 202. In one embodiment, the survey is performed with a wire line tool, EM-MWD, MWD, LWD, etc. This new survey will then generate a trigonometric wellbore position 214, which in turn will be transmitted to the geo-steering processes 204 to model and calculate a new stratagraphic position of the wellbore and generate a new target formation window 206, from data sources previously mentioned e.g. MWD, EM-MWD, LWD, rig surface equipment monitoring data drilling parameters, seismic, offset wells, etc. A feature of one embodiment is the integration of prior art survey techniques with geo-steering methods of this disclosure.

Figure 8:
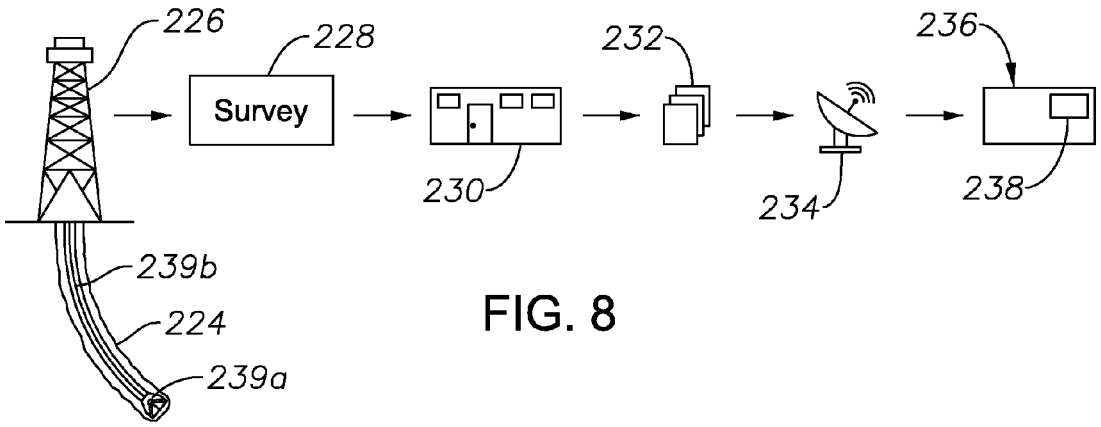
FIG. 8 is a schematic of the survey and geo-steering data flow process.

Referring now to FIG. 8, a schematic of the survey and geo-steering data flow process will now be described. As understood by those of ordinary skill in the art, a survey is taken on wellbore 224, which extends from a rig 226 (this will be via wireline survey e.g. EM-MWD, MWD, LWD, wireline steering tool, etc.), wherein the survey data and geo-steering data is denoted by the numeral 228. The bit 239*a* is seen attached to the workstring 239*b*. The survey data 228 is transmitted to the MWD unit 230 which will be on location at the rig 226. The MWD unit may also be referred to as the MWD dog house where the MWD surface equipment (including electronics) and personal are located at the drilling site. In other words, the MWD unit is on location at the rig 226. The rig surface monitoring equipment for monitoring data drilling parameters is also located at the rig site. The MWD unit will format all the data to a Log ASCII Standard (LAS) file 232 in the preferred embodiment. It should be noted that other file formats, such as WITS and WITSML, could be used. The LAS file 232 will then be transmitted to a remote site. This remote site maybe at the rig or located in a remote office far away from the rig. In one embodiment, the LAS file 232 will be transmitted via microwave transmission, satellite transmission, radio wave transmission, etc. 234 via known means to a command center 236 (also referred to as a remote control unit) that include a processor unit 238 (which is the geo-steering software location). The command center 236 will have contained therein means for modeling and calculating to project the stratagraphic target formation window herein described. The processor unit 238 includes software code instructions loaded onto the processor unit 238 that will evaluate, model and calculate all the data, in accordance with the teachings of this disclosure. Once the stratagraphic target formation window is generated 206, the information will be transmitted to the rig 226 where the generated data can be used to geo-steer and correct the well path to the new stratagraphic target formation window. In addition to the strata-graphic target formation window 206 being transmitted to the rig 226 the system will also have detailed drilling instructions pertaining to drilling distance required and orientation of the down hole drilling equipment to make the well path correction transmitted.

Figure 9:
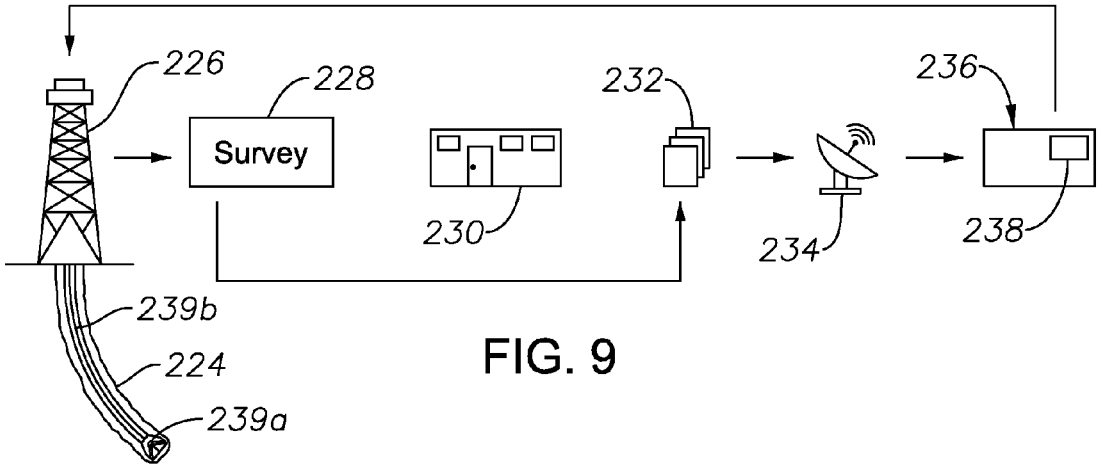
FIG. 9 is a schematic of another embodiment of the present data flow process.

FIG. 9 is a schematic of the one embodiment of the data flow process presented in this disclosure. As seen in FIG. 9, the survey data, geo-steering data and rig surface equipment monitoring data 228, after it's converted to the LAS file 232, is transmitted directly to microwave transmitter, satellite transmission, or radio wave transmission, etc. 234, wherein the data will be received at the command center 236, and wherein the data will be processed by the processor unit 238 as previously mentioned. Once the new stratagraphic target formation window is generated 206, the information will be transmitted directly to the rig 226 where the generated data can be used to geo-steer and correct the well path to the new strata graphic target formation window transmitted. In addition the strata-graphic target formation window 206 transmitted to the rig 226 will also have detailed drilling instructions pertaining to drilling distance required and orientation of the down hole drilling equipment to make the well path correction. Note that the MWD unit 230 will be bypassed.

Figure 10:
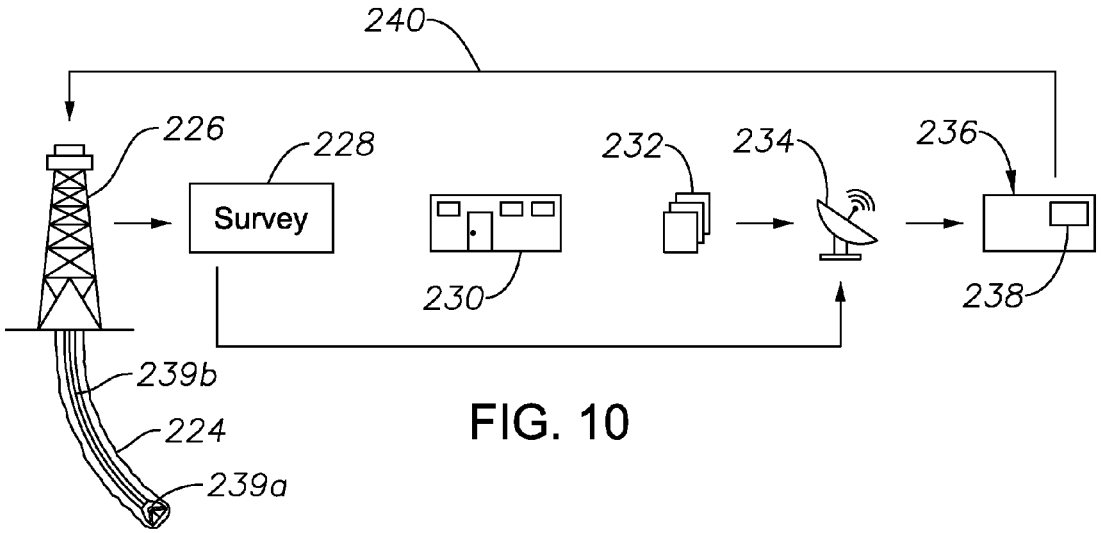
FIG. 10 is a schematic of another embodiment of the present data flow real time process.

Referring now to FIG. 10, a schematic of another embodiment of the present data flow process will now be described. As seen in FIG. 10, the survey data, geo-steering data and rig surface equipment monitoring data 228 is transmitted real time while drilling is in progress directly to microwave transmitter, satellite transmission, or radio wave transmission, etc. 234, wherein the data will be received at the command center 236 and wherein the data will be processed by the processor unit 238 as previously mentioned. Notice that this process by-pass the LAS file creation shown in FIG. 9 (see 232). While drilling ahead, data continues to be transmitted real time directly to microwave transmitter, satellite transmission, radio wave transmission, etc. 234, and the data will be received at the command center 236 and wherein the data will be processed by the processor unit 238 as previously mentioned. If it is determined that the real time stratagraphic target formation window shows a deviation from the previous survey data stratagraphic target formation window, a flag (i.e. message) is issued and sent by the command center 236 to stop drilling and perform a survey 240 (such as with a EM-MWD, MWD, LWD, wireline steering tool, etc.). Once the new survey information is obtained, the method of modeling, calculating and generating the stratagraphic target formation window depicted in FIG. 7 is initiated again and transmitted as per FIG. 10.

Figure 11:
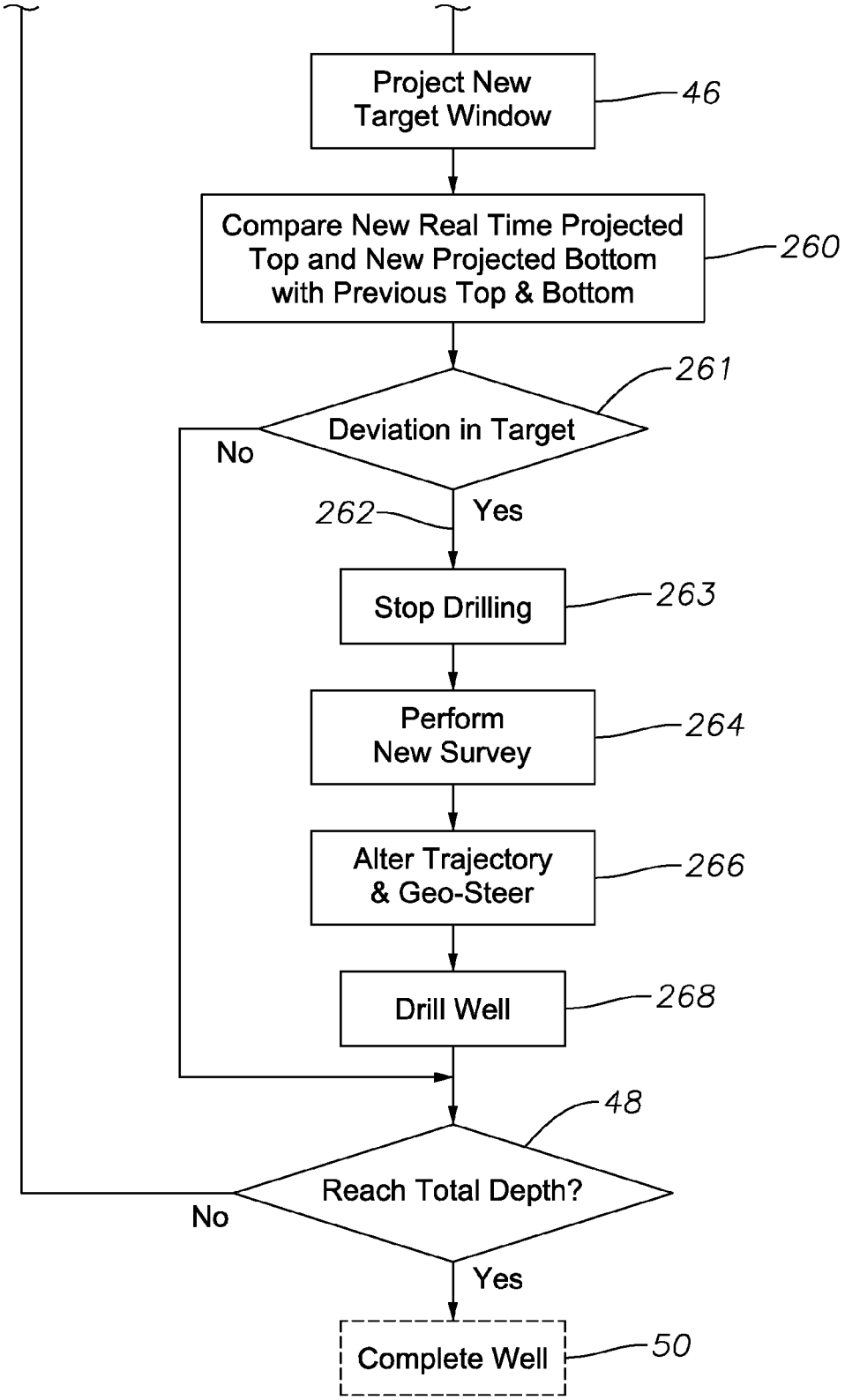
FIG. 11 is a flow chart of the method of the second embodiment.

FIG. 11 is a flow chart of the method utilizing the system illustrated in FIG. 7. Please note that steps 24 through 46 and steps 48 and 50 are the same as steps 24 through 46 and steps 48 and 50 seen in FIG. 3, and described earlier, and will not be repeated here. In other words, the steps 24-44 are seen in FIG. 3. As seen in FIG. 11, in step 260, the process includes comparing the new real time projected top and bottom target window with a top and bottom target window line that was generated from the previous, actual survey data. In the event that the comparison 261 results in a target deviation window change 262 (e.g. a projection that differs significantly which is approximately a deviation within +/−2'TVD to 4'TVD above or below the previous actual survey data target line), then a flag is generated, and the flag is then transmitted to the rig which in turn stops the drilling 263. Next, a new survey 264 will be taken. This will result in the updating of the model by evaluating the survey data, geo-steering data and rig surface equipment monitoring data as mentioned above, altering of the trajectory via geosteering 266 and then further drilling 268 while comparing it to the next real time target formation window model. The process loops back to comparing the new target with the top and bottom target line that was generated from the previous, actual data in 260. If no deviation is found, then the process returns to whether the driller has reached the total depth (the step 48). Hence, if a deviation is found (step 262), a new survey will need to be taken (264) and the process continues as previously set forth.

Figure 12:
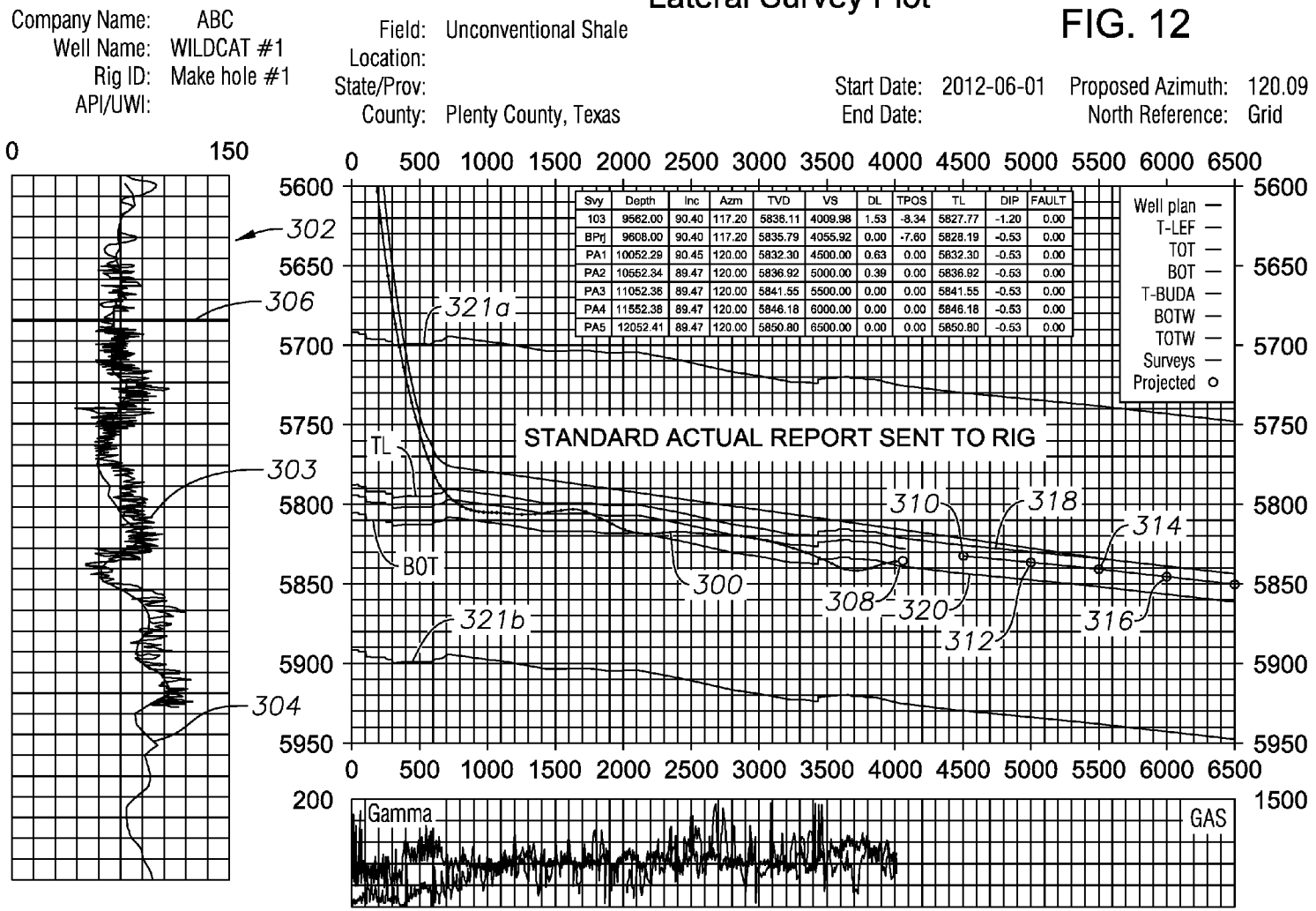
FIG. 12 a wellbore plot according to the second embodiment of the process herein disclosed.

FIG. 12 is a wellbore plot and chart produced as a screen shot according to one preferred embodiment (e.g. embodiment of FIG. 7) of the process herein disclosed. FIG. 12 depicts the plot of the survey and geo-steering data produced with formatted LAS data that is transmitted to the command center. Line 300 represents the past actual position of the wellbore. The chart in FIG. 12 contains columns and rows. Row 103 represents an actual survey that is transmitted as noted earlier as a LAS data set with the dip being used to model the data. The graph to the left (seen generally at 302) depicts the survey 103 modeled data. The data 303 is previous actual data that has been previously modeled, and the line 304 is the offset/control log that the method used to model actual data to and the line 306 is the production zones target line (also referred to as "TL") in the offset/control log well bore. The rows in the chart marked BPrj, PA1-PA5 are data that is projected ahead of the actual data using the average DIP data from the previous actual data the system has already positioned by using formation dip modeling. BPrj stands for bit projection and PA stands for project ahead. In the chart seen in FIG. 12, the system uses the last actual average formation dips modeled from the past 3, 5, 10 or whatever actual data sets are chosen. The average produced is placed in the DIP column and the method generates the depth, inclination, and azimuth needed to produce a TPOS of zero (which is that rows distance (position) from the target line). On the graph, the first circle 308 is the BPrj, which is the bit projection station's stratagraphic position, and the stratagraphic position of the next circle 310 is station PA1, circle 312 is PA2, circle 314 is PA3, circle 316 is PA4. Hence, the chart in FIG. 12 builds the projected stratagraphic target window from the distance away (TPOS) from target line (TL) and creates the top of target 318 and bottom of target 320 and gives the measured depth, inclination and azimuth required to reach that circles TL position on the graph. The TPOS target line position also produces additional upper and lower formations labeled T-LEF 321*a* and T-BUDA 321*b*, respectively. Also, the lower graph plot in FIG. 12, compares and evaluates geo data against the rig surface equipment monitoring data.

Figure 13:
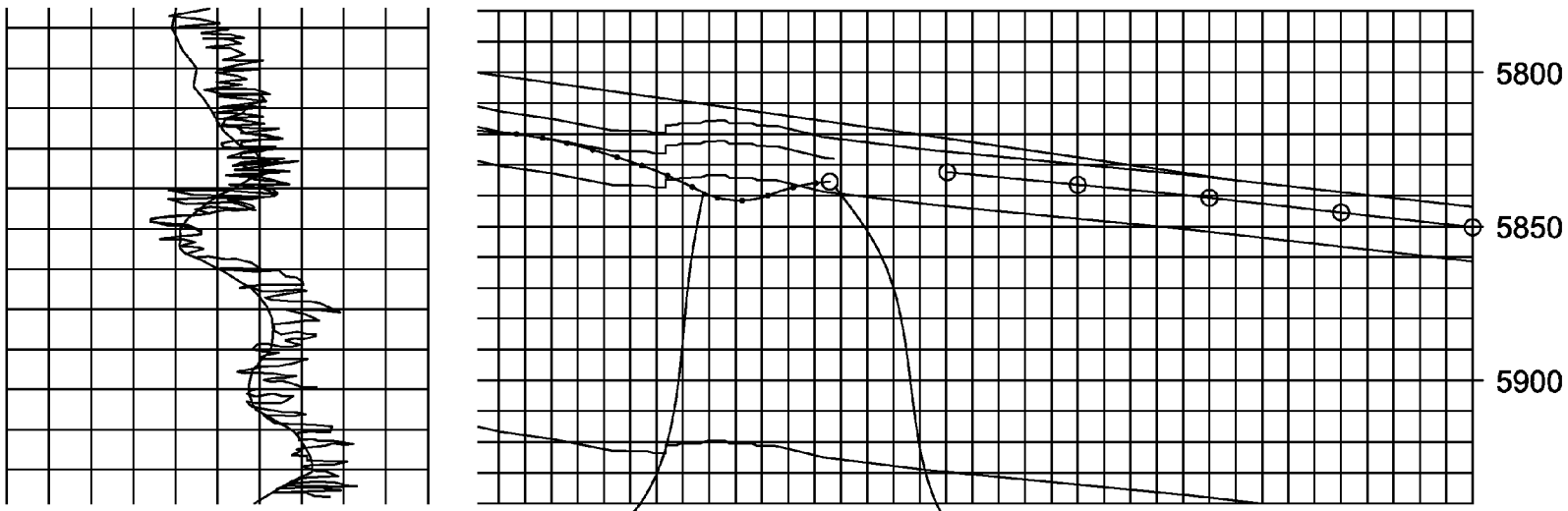
FIG. 13 an exploded view of the wellbore plot seen in FIG. 12.

FIG. 13 is an exploded view of the wellbore plot and chart seen in FIG. 12 as well as an additional row of data from survey 102 above the column headings. Line 300 is the actual position of the wellbore and circle 308 is the bit projection station which represents the last known actual projected position and inclination of the bit. The following calculations are illustrative of the method disclosed herein (NOTE: "A", "B", and "C" represent rows 1, 2, and 3, respectively, in the chart of FIG. 13):

SVY103: TLB=TAN(DIPB) (−1)*(VSB−VSA)+TLA

TOTB=TAN(−1.2) (−1)*(4009.98−3915.10)+5825.78

SVY103: TLB=5827.77 [0074] SVY103: TPOS=TLB−TVDB

TPOS=5827.77-5836.11=−8.34

BPrj: TLC=TAN(DIPC) (−1)*(VSC−VSB)+TLB

TOTC=TAN(−0.53)(−1)*(4055.92−4009.98)+5827.77

BPrj: TLC=5828.19

BPrj: TPOS=TLC−TVDC

BPrj: TPOS=5828.19−5835.79=−7.6

The rest of the chart for the PA stations uses the same calculations once you set the dip value.

A fault value if positive is a shift data up and adds TVD to the TL. A fault value if negative is a shift data down and subtracts TVD from the TL.

Hence, once the data set is modeled with a dip, that dip appears in the dip column of the survey row 103 and it is used to calculate where the target line (TL) true vertical depth (TVD) is located at that rows vertical section (VS) distance. Thus, the dip calculates how far the TL has moved from row to row and uses the TL TVD to subtract from the survey row or PA row TVD to determine how far away (TPOS) the actual or projected well bore is from the TL assuming the DIP columns value. Each line uses the same line by line calculation to achieve the target line TVD and TPOS the wellbore is from each line's TVD. The graph plots the TVD (y-axis) of the actual survey 103 (which is line 300), the BPrj circle 308 and its respective vertical section (VS) column (x-axis). The project ahead circle stations plot the same according to the target line TVD on the y-axis and vertical section (VS) column (x-axis).

FIG. 14 is a sequential view of the wellbore plot seen in FIG. 12 according to the present method. The target line which creates the target window top 322 and the target window bottom 324 (thereby forming the target window) is built just like the chart above with the real time data while drilling. The graph to the left shows a piece of streamed data 325 that was modeled with a −0.40 DIP (shown above in the chart in the survey row 104 in DIP column). By plotting target line 340, real time data (i.e. top 322 and bottom 324) are created, the operator can check to see how well target line 340 correlates to what was modeled from the actual survey data transmitted via LAS file format or any other format (WITS, WITSML, etc.). Hence, it appears that the −0.53 calculated average DIP (from previous modeled actual survey data) in the project ahead stations correlates well to the −0.40 DIP from the real time data modeled on the projected top 322 and bottom 324. Thus, no immediate change is needed from the directional driller and drilling can proceed. FIG. 15. is a chart providing real time data used in the generation of the TL to create the top 322 and bottom 324 targets seen in FIG. 14.

FIG. 16 is a sequential view of the wellbore plot seen in FIG. 14. As more data is streamed in real time as drilling continues, the operator will note that circumstances have changed as compared to the plot of FIG. 14. The real time data to the left (line 326) is modeled from the survey row 104 DIP of −1.9 and the produced TL 340 that creates the window top 328 and bottom 330 reflects this projection. As seen in FIG. 16, the target window is dipping down more than the actual average previous target window modeled at −0.53 DIP (lines 332, 334). Thus, a flag is generated and a message is transmitted to the rig to stop drilling and take an actual survey with geo-steering data, which can be a wireline survey tool, EM-MWD, MWD, LWD, etc. In this way, the command center can receive the actual survey and geo-steering data (in the LAS data format, WITS or WITSML, for instance) to model and then transmit an updated stratagraphic target formation window. The upper chart is the actual data from the previous survey. The project ahead stations on the upper chart plot the target line which creates the plot of the top of target 332 and the bottom of target 334 window on the graph. The current real time data is modeling to show a −1.9 down dip which is on the chart at the survey row 104, column DIP. FIG. 17 is a chart providing real time data used in the generation of the TL that creates the top 328 and bottom 330 targets seen in FIG. 16 along with the PA station circle TPOS locations. The chart is the real time data chart which is represented by the graph of the top 328 and the bottom 330. The method averages the last 500' of DIP values already modeled including the −1.9 degree dip and came up with a possible average formation DIP ahead of −0.97 down dip. Hence, while it was initially modeled that the dip average would be −0.53 down dip, but since the −0.53 down dip is not matching in real time, the method generates a flag regarding the deviation and a message is sent to stop drilling and take an actual survey and geo data shot, along with rig surface equipment monitoring data and make changes.

FIG. 18 is a sequential view of the wellbore plot seen in FIG. 17. This represents the average dip change made from the addition of an actual survey data set taken once the flag was generated and message sent from the command center 236. The new average dip used to model the new TL (340) that creates the target window (top 328 and bottom 330) is −0.97 down dip as seen in the chart versus the −0.53 down dip depicted in FIG. 16. Hence, the real time data streaming in and modeling with the method herein described were able to make a correction to the well path sooner rather than waiting until the driller drilled to the next survey station to gather actual data. In addition, the new PA stations give direct instructions in how far to drill and at what orientation to achieve the new well path generated from the above process. This will expedite well path corrections and keep the well path on course. In addition, it will allow the drilling team to better manage their slide drilling time for corrections versus their rotate drilling time for maintaining wellbore course. By optimizing the rotary drilling time versus the slide drilling time wells can be drilled faster and smoother than they are conventionally drilled yielding cost savings.

As per the teachings of the present invention, the operators can utilize a remote personal tablet to receive and send survey and log data anywhere around the location via a wireless remote router. Hence, reception and transmission is possible from the mud logger shack, the dog house or from the edge of the location. The command center can stream multiple wells at one time, process the data and generate models as set out herein. In addition, the wells can be monitored with personal tablets, smart phones and laptops that are commercially available from manufactures such as Apple, Inc., Microsoft Inc., Verizon Inc., etc.

Although the present invention has been described in considerable detail with reference to certain preferred versions thereof, other versions are possible. Therefore, the spirit and scope of the appended claims should not be limited to the description of the preferred versions contained herein.

Although the invention has been described in terms of certain preferred embodiments, it will become apparent that modifications and improvements can be made to the inventive concepts herein without departing from the scope of the invention. The embodiments shown herein are merely illustrative of the inventive concepts and should not be interpreted as limiting the scope of the invention.

While these embodiments have been described with emphasis on the embodiments, it should be understood that within the scope of the appended claims, the embodiments might be practiced other than as specifically described herein.

What is claimed is:

1. A method of drilling a subterranean well from a surface location comprising:

a. estimating a target formation depth;

b. estimating a target formation dip angle;

c. calculating a target line that creates a top and bottom of the target formation that forms a first projection window;

d. drilling within the first projection window;

e. transmitting information from the subterranean well;

f. projecting a target deviation ceasing the drilling of the well; and g. performing a well survey so that well survey information is generated.

2. The method of claim 1, further comprising:

a. estimating a formation dip angle with the well survey information;

b. calculating a first revised target line that creates a revised top and bottom of the target formation that forms a second projection window;

c. drilling within the second projection window; and d. transmitting information from the subterranean well.

3. The method of claim 2, further comprising:

a. projecting a second target deviation;

b. ceasing the drilling of the well; and c. performing a second well survey so that well survey information is generated.

4. The method of claim 3, wherein the step of estimating the target formation depth includes using offset well data.

5. The method of claim 4, wherein the offset well data includes data from electric line logs.

6. The method of claim 5, wherein the step of transmitting information from the subterranean well includes obtaining information with a logging while drilling (LWD) tool.

7. The method of claim 6, wherein the logging while drilling (LWD) tool includes means for obtaining a resistivity log.

8. The method of claim 7, further comprises:

a. drilling the well; and b. completing the well for production.

* * * * *